US009021687B2

(12) United States Patent
Schuler et al.

(10) Patent No.: US 9,021,687 B2
(45) Date of Patent: May 5, 2015

(54) DEVICE FOR ASSEMBLING A WINDOW SASH HAVING AN INTEGRATED INSULATING GLASS PANE

(75) Inventors: Peter Schuler, Tiefenbronn (DE); Stephan Kammerer, Neuhausen (DE); Uwe Bogner, Pforzheim (DE)

(73) Assignee: Bystronic Lenhardt GmbH, Neuhausen-Hamberg (DE)

( * ) Notice: Subject to any disclaimer, the term of this patent is extended or adjusted under 35 U.S.C. 154(b) by 397 days.

(21) Appl. No.: 13/499,028

(22) PCT Filed: Sep. 11, 2010

(86) PCT No.: PCT/EP2010/005578

§ 371 (c)(1),
(2), (4) Date: May 25, 2012

(87) PCT Pub. No.: WO2011/038832

PCT Pub. Date: Apr. 7, 2011

(65) Prior Publication Data

US 2012/0266455 A1 Oct. 25, 2012

(30) Foreign Application Priority Data

Sep. 30, 2009 (DE) ..... 10 2009 048 642

(51) Int. Cl.

| | |
|---|---|
| ***E06B 3/673*** | (2006.01) |
| ***E06B 3/24*** | (2006.01) |
| ***E06B 3/64*** | (2006.01) |

(52) U.S. Cl.

CPC ... *E06B 3/24* (2013.01); *E06B 3/64* (2013.01); *E06B 3/67365* (2013.01); *E06B 3/67386* (2013.01)

(58) Field of Classification Search

CPC .... B23P 19/04; B23P 21/004; B23P 2700/50; B23P 21/006; B62D 65/02; B62D 65/18; H05K 13/08

USPC ..... 29/711, 714, 797, 791, 795

See application file for complete search history.

(56) References Cited

U.S. PATENT DOCUMENTS

| | | | | |
|---|---|---|---|---|
| 6,286,288 | B1 | 9/2001 | France | |
| 7,097,724 | B2 | 8/2006 | Hornung et al. | |
| 7,785,432 | B2 * | 8/2010 | Lenhardt | 156/109 |
| 8,381,382 | B2 * | 2/2013 | Wunnicke et al. | 29/430 |
| 2005/0132663 | A1 | 6/2005 | Guhl et al. | |
| 2005/0166491 | A1 | 8/2005 | Hornung et al. | |
| 2008/0116042 | A1 * | 5/2008 | McAlister et al. | 198/836.3 |

FOREIGN PATENT DOCUMENTS

| | | |
|---|---|---|
| WO | WO 03014511 | 2/2003 |

* cited by examiner

*Primary Examiner* — Alexander P Taousakis
*Assistant Examiner* — Lee A Holly
(74) *Attorney, Agent, or Firm* — D. Peter Hochberg; Sean F. Mellino

(57) ABSTRACT

A device for assembling a window sash having an integrated insulating glass pane. The window sash has a frame made from a plastic hollow profile section. On the inner face thereof, the frame has two webs parallel to each other which are adhesively secured to two glass panes that are held spaced apart by the two webs. The device has a horizontal conveyor, which is provided to be vertically adjustable, on an underframe.

16 Claims, 19 Drawing Sheets

DEVICE FOR ASSEMBLING A WINDOW SASH HAVING AN INTEGRATED INSULATING GLASS PANE

CROSS-REFERENCE TO RELATED APPLICATIONS

This application is a National Stage application of International Application No. PCT/EP2010/005578, filed on. Sep. 11, 2010, which claims priority of German patent application number 10 2009 048 642.9, filed on Sep. 30, 2009, both of which are incorporated herein by reference in their entireties.

BACKGROUND OF THE INVENTION

1. Field of the Invention

The present invention relates to the field of assembling window sashes. More specifically, the present invention relates to a device for assembling a window sash having an integrated insulating glass pane.

2. Description of the Prior Art

The invention starts at a method comprising the features specified in the preamble of claim 1, namely, a method for forming a device for assembling window sashes comprising an integrated insulating glass pane, wherein the window sashes comprise a frame formed from plastic hollow profiles comprising an inner face, an outer face facing away from the inner face, and two flanks which connect the inner face and the outer face to each other, wherein the frame, on the inner face of the frame comprises two webs which are parallel to each other, which constitute an all-around delimitation of the window opening of the window sash and which are adhesively secured to two glass plates which are held spaced apart by the two webs. Such a method is known from U.S. Pat. No. 6,286,288 B1 and from U.S. Pat. No. 7,097,724 B2 for producing sliding sashes. These publications disclose window sashes for sliding sashes and methods for the production thereof, which are known under the identification "sashlite".

In the case of the "sashlite" method, a rectangular or square frame is initially formed from an extruded plastic hollow profile, in that the four legs of the frame are cut from the plastic hollow profile and are welded to each other in pairs at their ends by means of ultrasound for forming the corners of the frame. On its inner face, the frame has two webs, which are parallel to each other. A paste-like adhesive compound, in which a moisture-binding material, in particular molecular sieves in the form of powder, is embedded, is injected into the space between these two webs. A line of a sealing and adhesive compound, by means of which two glass plates are adhesively secured to the two webs, which serve as spacers for the two glass plates, is applied all around, at all four legs of the frame, on the outside of the two webs. Such a sealing and adhesive compound will hereinbelow be referred to as sealing compound. It has the object of establishing a fixed connection between the webs of the frame, which are directed inwardly, and the glass plates, and to seal the gap between the webs and the glass plates against the penetration of moisture and against a loss of a heavy gas, which is possibly filled into the space between the glass plates.

The premanufactured frame is placed onto a horizontal conveyor track and is conveyed to a processing station, in which the adhesive compound, which includes the moisture-binding material, is initially injected into the space between the two webs at all four legs of the frame. Said space is open towards the respective opposite leg of the frame. A line of the sealing compound is then applied to the one of the two webs, which is located on the top, and a first glass plate is adhesively secured thereto. The frame is then turned over on the horizontal conveyor track, so that the web having the first glass plate, which adheres thereto, is located on the bottom and the second one of the two parallel webs is located on top. A line of the sealing compound is then applied all around to the web, which is now located on top, and the second glass plate is adhesively secured to this line.

Outside of the area, which is covered by the glass plates, one of the two webs has a bore, which leads into the space between the glass plates. The space between the two glass plates can be vented by means of this bore when the two glass plates are pressed against the webs, whereby the space between the glass plates is decreased. The pressing of the glass plates takes place in that, e.g., rollers act on the glass plates in the area of the two webs and the glass plates are pressed against the webs through this, whereby the sealing compound is flattened and the gap between the two glass plates is sealed. It is known as another possibility for pressing the two glass plates of a sashlite window against the two webs of the window frame, to suck air from the space between the two glass plates through the bore, which is provided in one of the webs, so that a low pressure, which pulls the glass plates against the webs and thus flattens the sealing compound, is created in the space.

In the case of the sashlite method, it is furthermore known to insert two small tubes into the bore in one of the two webs of the window frame. A heavy gas, e.g. argon, is blown through one of the small tubes into the space between the two glass plates. Air or a mixture of air and the heavy gas is extracted from the space between the two glass plates by suction through the other small tube. Through this, the air in the space between the glass plates is partially replaced with the heavy gas, whereby the heat transfer between the two glass plates is made difficult. After such a gas exchange, the bore in the web of the frame is sealed.

Lastly, cover strips, which cover the edge of the glass plates towards the outside, are also inserted into the frame. The window sash having the integrated insulating glass pane is thus finished.

For the most part, the known sashlite method is carried out manually. It is disadvantageous that the personnel costs are high and that quality deficiencies are unavoidable.

SUMMARY OF THE PRESENT INVENTION

The device according to the invention is the subject matter of patent claim 1. Advantageous refinements of the device are the subject matter of the subclaims.

The device according to the invention for assembling window sashes having an integrated insulating glass pane, which window sashes have a frame formed from plastic hollow profiles, said frame having an inner face, an outer face facing away from the inner face, and two flanks, which connect the inner face and the outer face to each other, wherein, on its inner face, the frame has two webs, which are parallel to each other, which constitute an all-around delimitation of the window opening of the window sash and which are adhesively secured to two glass plates, which are held spaced apart by means of the two webs, is equipped with the following features:

- with a horizontal conveyor, which is provided on an underframe so as to be height-adjustable,
- with a framework, which is attached to the underframe and which projects upwards from the underframe, to which at least three rows of support elements, which are located next to one another, are attached above the horizontal conveyor and parallel to it, said support elements being height-adjustable and arranged such that they can support and guide glass plates conveyed on the horizontal conveyor and frames in vertical position or in a position, which is inclined backwards by a few degrees, with a front framework, which is supported in front of the horizontal conveyor on the underframe and which is embodied in a frame-shaped manner and which can be displaced transversely to the horizontal conveyor on the underframe, with a rear framework, which is arranged behind the horizontal conveyor on the underframe and which is embodied in a frame-shaped manner and which can be displaced transversely to the horizontal conveyor on the underframe, wherein a horizontal traverse is supported at the front frame as well as at the rear frame so as to be capable of being displaced up and down and a vertical traverse is supported so as to be capable of being displaced horizontally, with thrust plates, which are attached to a stationary lower traverse, to the displaceable horizontal traverse, to the displaceable vertical traverse and to a post of the front framework and of the rear framework, which posts project upward parallel to the vertical traverse and which thrust plates can be displaced transversely horizontally or inclined by a few degrees against the horizontal, respectively, in particular at right angles to the conveying direction of the horizontal conveyor, wherein the thrust plates attached to the front framework can be pushed ahead in the direction of the rear framework and the thrust plates, which are provided at the rear framework, can be pushed ahead in the direction of the front framework, and with suction devices, which are provided at the front framework as well as at the rear framework and the suction devices, and wherein the suction devices attached to the front framework face the rear framework, while the suction devices provided at the rear framework face the front framework.

The invention has considerable advantages:

The set-up of the frame and of the glass plates in vertical position or in a position, which is inclined by a few degrees against the vertical, and the carrying out of the operating steps, which lead to an assembled window sash, in such a device, in which the frames and glass plates are assembled so as to be set up vertically or approximately vertically, is a basic principle for a considerable rationalization of the assembly method;

Personnel costs are saved;

The operating steps, which take place machine-based in the assembly process, are independent from individual weaknesses and errors of the operating personnel;

The quality of the window sashes, which are assembled in the new device, is increased considerably and the operating life of the integrated insulating glass pane is lengthened considerably;

The frames and glass plates can be moved by machine independent from one another in the new device and can be adjusted prior to the assembly. Adjusting errors can be eliminated in this manner for the most part;

Due to the provided displaceable traverses at the front framework as well as at the rear framework, the device can easily be adapted to changing formats of the frames and glass plates;

Due to the fact that provision is made for two frameworks, which can be moved independent from one another, one of which is located in front of the horizontal conveyor and one of which is located behind the horizontal conveyor, the device can also be adjusted easily to changing thicknesses of the frames, to changing thicknesses of the glass plates and to changing distances of the glass plates in the window sash;

By means of the provided thrust plates, the glass plates can be adhesively secured to the frame using even pressure, specifically in the area, where it is necessary, namely in the edge area of the glass plates, whereby an adhesion, which can be repeated well and evenly and which is important for the sealing of the integrated insulating glass pane, is made possible;

By means of the suction devices, the glass plates can be fixed in the device after they have been accurately positioned in conveying direction. After the fixing of the glass plates, the frame can be oriented in the desired height relative to the glass plates, in which an accurate assembly is made possible with repeatable accuracy.

Preferably, the horizontal conveyor is a three-track horizontal conveyor. This makes it possible to move the two glass plates and the frame independent from one another even though this is to be avoided, if possible, due to a short clock time of the device. For adjusting purposes, the possibility of moving the glass plates and the frame independent from one another, however, is welcome.

Preferably, the three-track horizontal conveyor has three conveyor belts, which are located next to one another, the upper runs of which are located in a common plane. This facilitates the connection of the device to sections of a production line, which are connected upstream and on which the glass plates and the frames are prepared for the assembly and in the easiest manner are conveyed at the same level. The required different orientation of the glass plates on the one hand and of the frames on the other hand in their height relative to one another is then finally carried out in the device according to the invention.

The support elements, which are to support and guide the glass plates and the frame at some distance to the horizontal conveyor, preferably in the vicinity of their upper edge, are preferably free-running rollers, the axes of which are arranged vertically or inclined backwards by a few degrees against the vertical, respectively. The slight backwards incline has the advantage that the glass plates and the frames can be disposed on the free-running rollers at a corresponding incline, which secures them against a forwards tilting—in particular during the conveying. The upper runs of the conveyor belts should accordingly be inclined backwards, so that the axes of the free-running rollers are located perpendicularly to the common plane of the upper runs.

In the case of the front framework as well as in the case of the rear framework of the device, a part of the thrust plates is preferably assembled on slides, one of which can in each case be displaced longitudinally on the fixed lower traverse, one on the movable horizontal traverse, one on the movable vertical traverse and one on the vertical post of the frame, which post is located opposite to the vertical traverse and wherein each one of the said slides tows a slidable lattice grate, which changes its expansion due to the displacement movement and to which further thrust plates are attached, the distance of which relative to one another and the distance of which from the thrust plates mounted on the respective slide changes due to the movement of the slide. The movement of the slides can be coupled to the movement of the movable traverses. It has the advantage that the change of the expansion of the slidable lattice grate can make it possible that the thrust plates, which are to press the glass plates against the webs of the frame, act on the edge area of the glass plates at sufficiently even intervals, and thus ensure an even pressing of the sealing compound between the glass plates and the webs of the frame.

Preferably, provision is made at the movable horizontal traverse of the front framework as well as of the rear framework for adjusting devices, which have arms, in particular in the shape of bars, which can be pushed forward from the displaceable horizontal traverse of the front framework transversely to the conveying direction of the horizontal conveyor in the direction of the opposite rear framework, whereas the adjusting devices, which are provided at the displaceable horizontal traverse of the rear framework, can push their arms forward transversely to the conveying direction of the horizontal conveyor in the direction of the opposite front framework. Through this, the upper leg of the frame can be adjusted in its position, which is desired for the assembly, and in particular a sagging, which it could have, can be compensated in that the arms of the adjusting devices are moved underneath the upper leg of the frame, so that, during the lowering of the frame, it hits the arms, which determine the required position of the upper frame leg.

Preferably, the adjusting devices, the thrust plates and the suction devices can be activated individually, in particular by means of pneumatic cylinders. This facilitates the adaptation of the device to different formats of the glass plates and frames.

The heat transfer through insulating glass panes can be reduced when the air in the interior of the insulating glass pane is completely or partially replaced by a heavy gas. To also make this possible in the case of a window sash according to the invention, provision is preferably made either at the front framework or at the rear framework for suction devices, which are oriented against the opposite framework and by means of which an adjacent glass plate, which stands on the horizontal conveyor, can be aspirated and can be bent backwards, that is, away from the opposite glass plate, at two diagonally opposite corners. In this case, two accesses to the interior space remain initially open during the assembly of the window sash, whereby the heavy gas is introduced through an access, preferably through the lower access, which heavy gas then rises in the space between the two glass plates and which displaces the air through the upper access. Such an embodiment is possible in a particularly simple manner in the case of the device according to the invention.

To simplify matters, the instant patent application discusses a window sash. The term "window sash" is to include slidable sashes as well as pivotable sashes as well as the wings of a door comprising an integrated insulating glass pane.

BRIEF DESCRIPTION OF THE DRAWINGS

An exemplary embodiment of the invention will be specified below by the enclosed drawings.

DETAILED DESCRIPTION OF THE INVENTION

Figure 1:
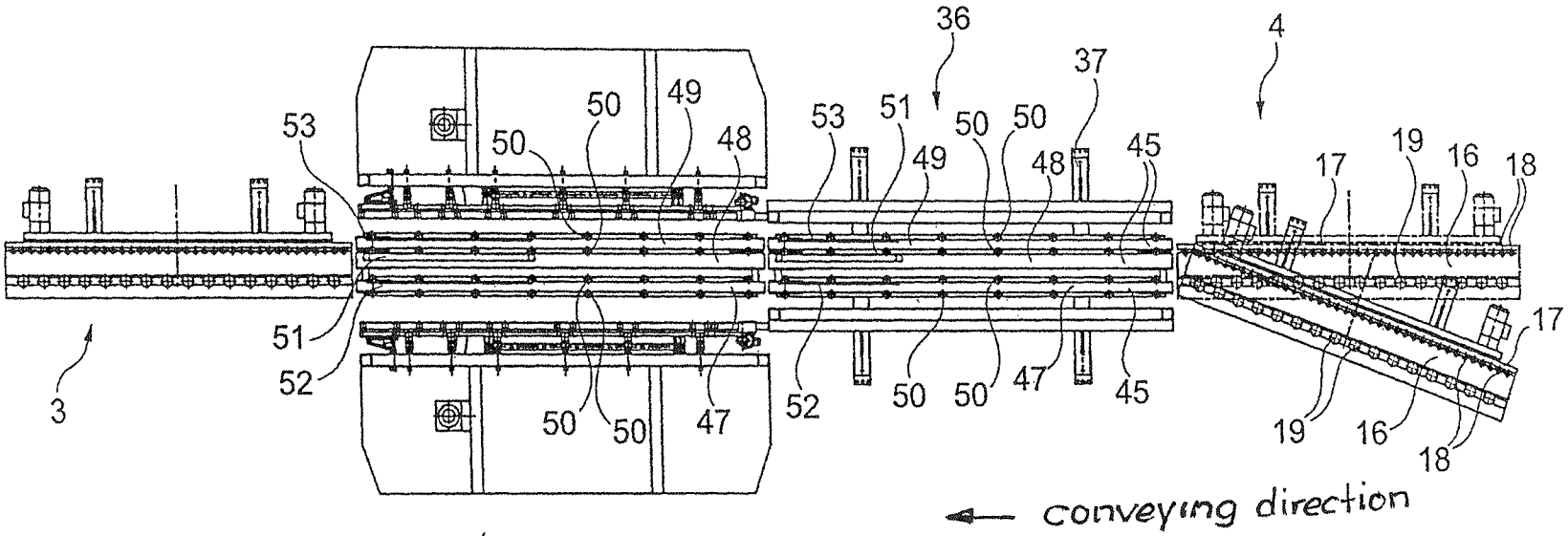
FIG. 1 shows, in top view, a first section of an assembly line for window sashes having an integrated insulating glass pane.
Figure 2:
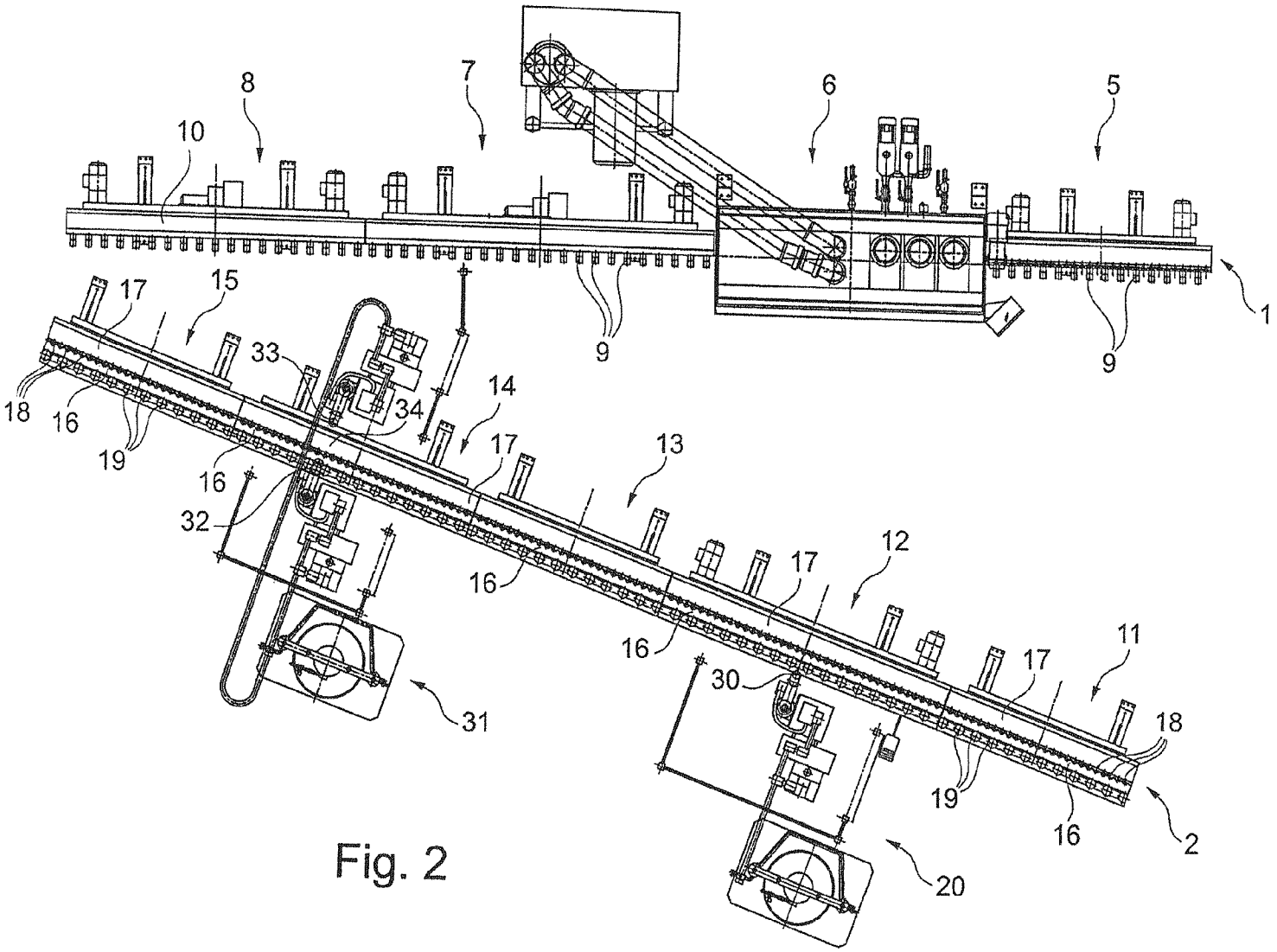
FIG. 2 shows a top view of a second section of the assembly line for window sashes having an integrated insulating glass pane.
Figure 3:
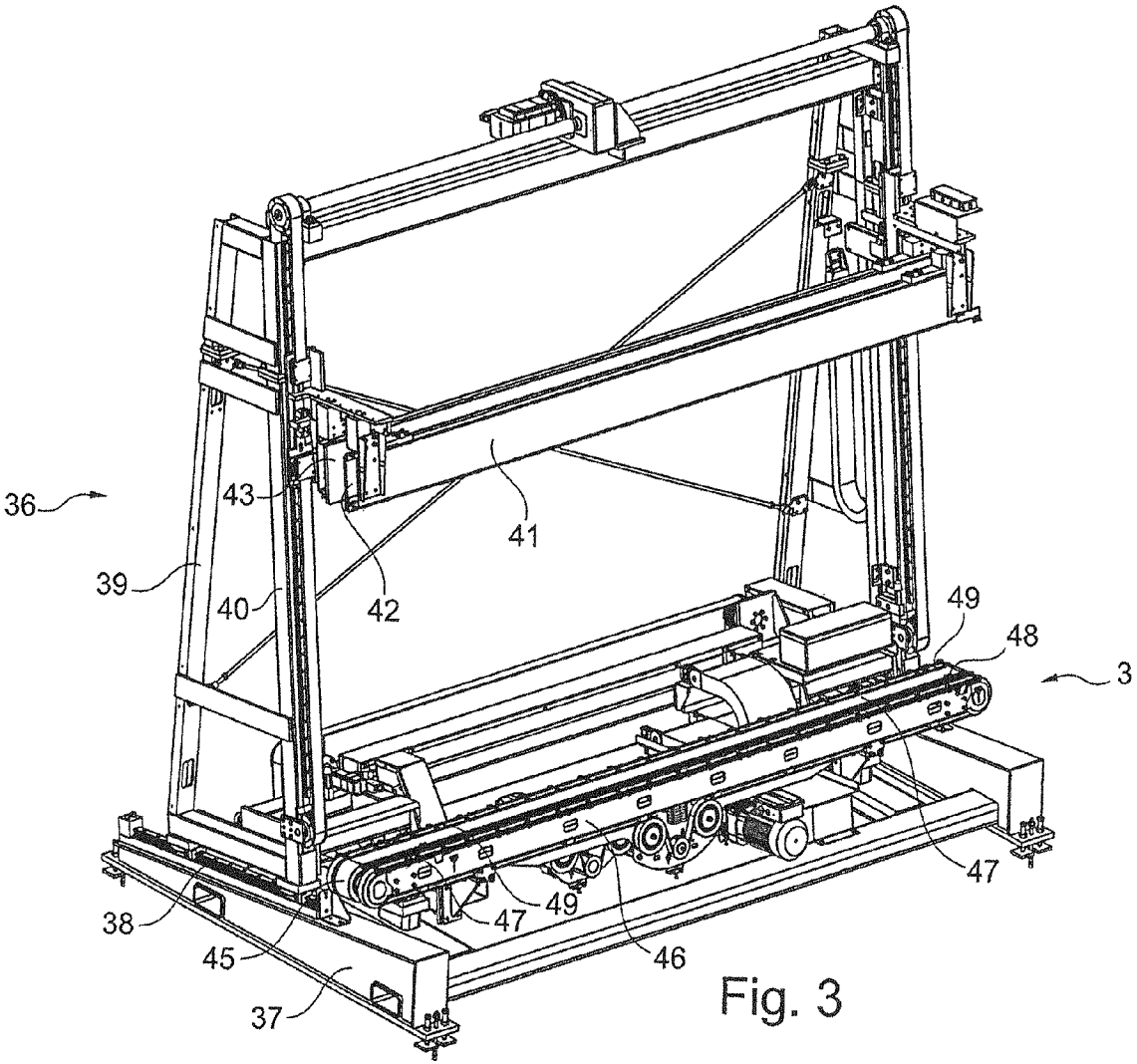
FIG. 3 shows the preparation station from FIG. 1 in a transversal view.
Figure 4:
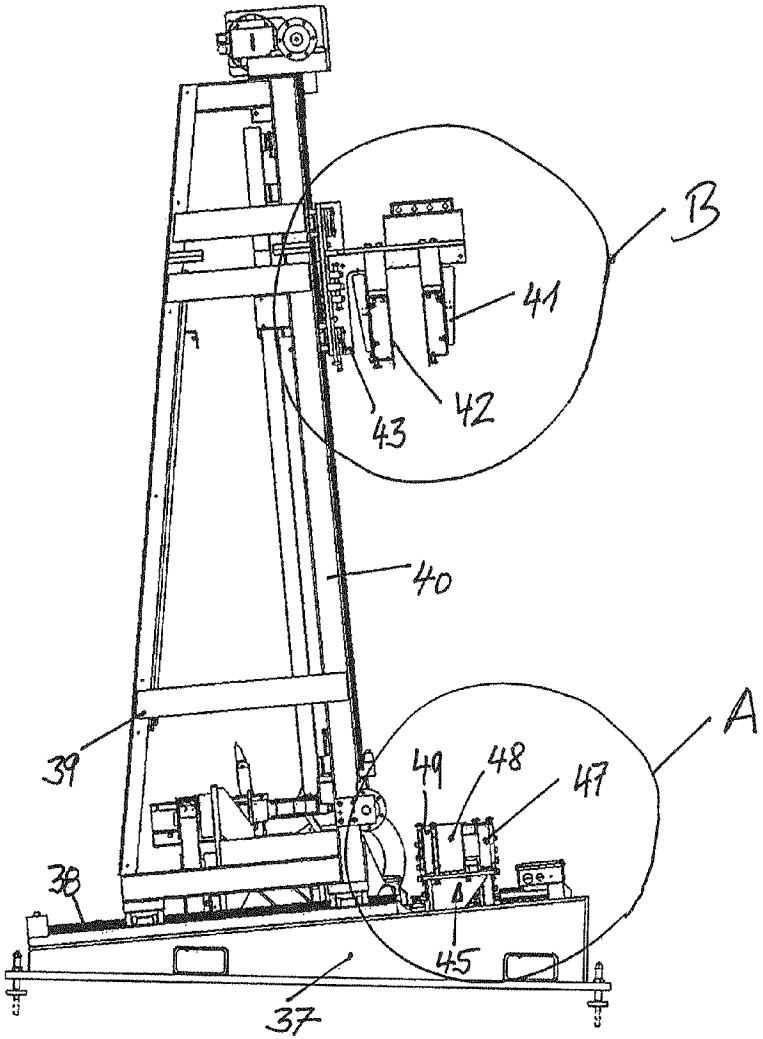
FIG. 4 shows the preparation station from FIG. 3 in a side view with viewing direction parallel to the conveying direction.
Figure 5:
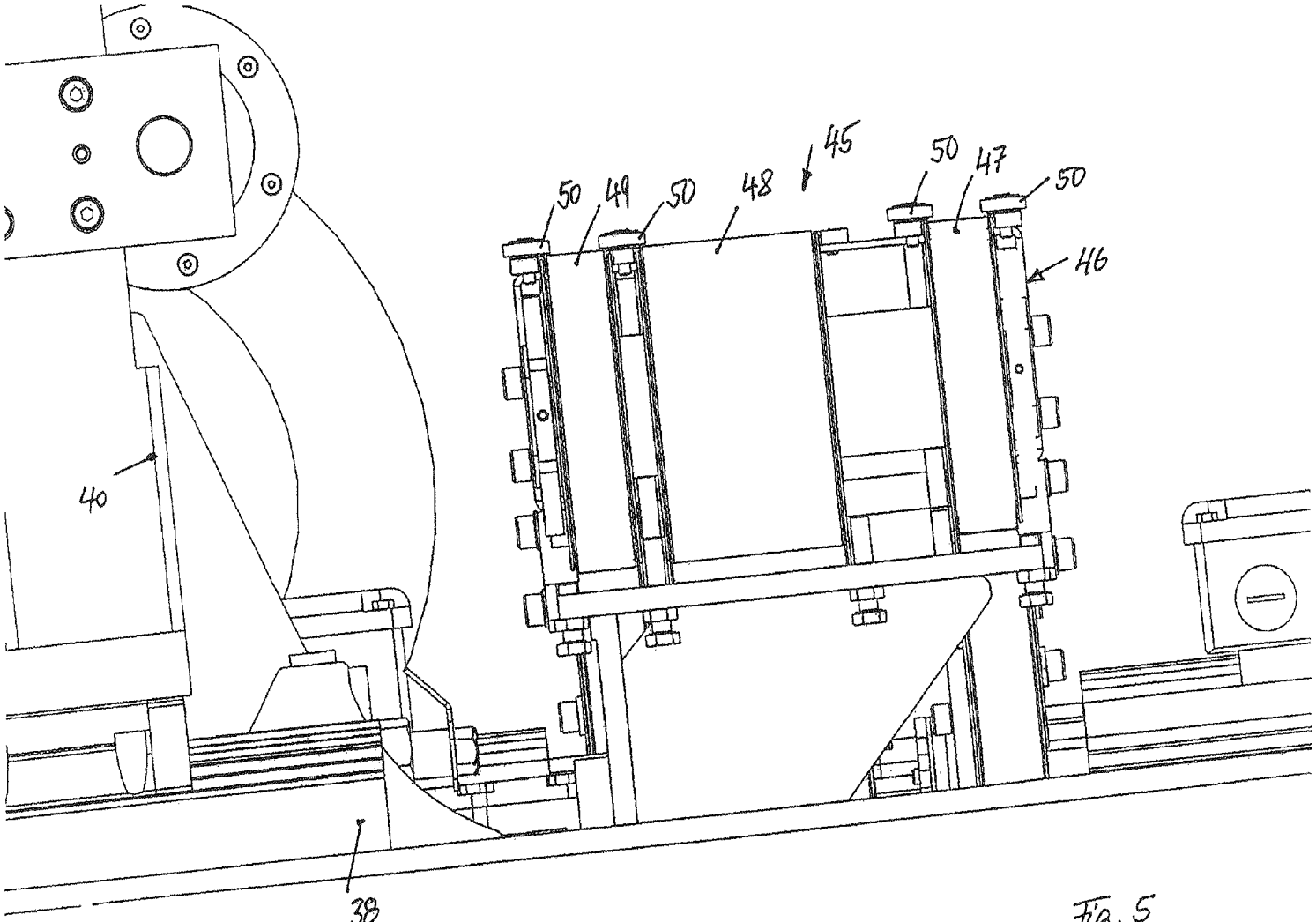
FIG. 5 shows the section A from FIG. 4 as detail.
Figure 6:
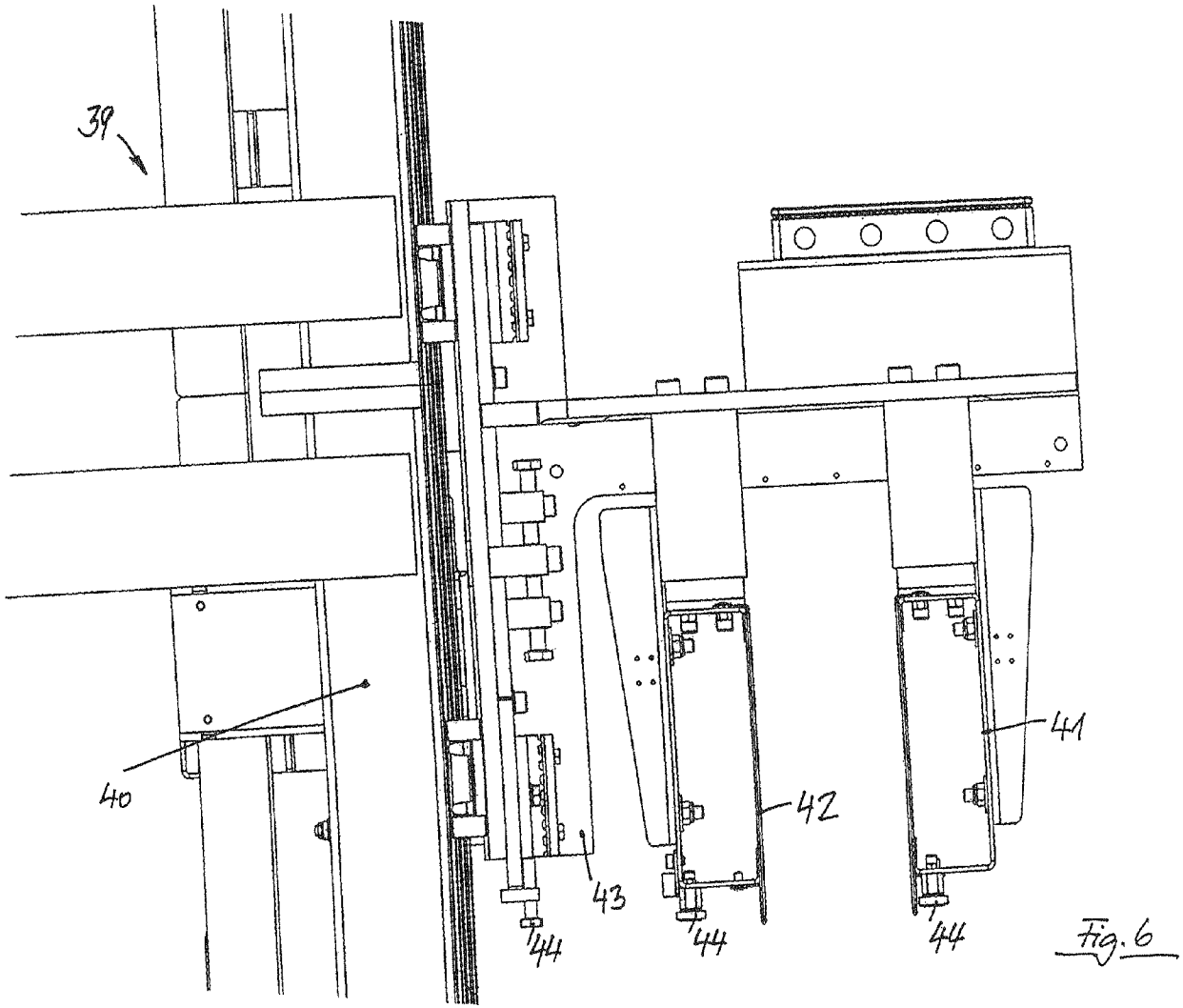
FIG. 6 shows section B of from FIG. 4 as detail.

FIGS. 1 and 2 show, in a schematic top view, a production line for window sashes or the wings of a door having an integrated insulating glass pane. To simplify matters, only window sashes will be discussed below. However, the same applies to the wings of a door. The term "sash" is to comprise displaceable as well as pivotable sashes.

The illustration in FIG. 2 connects to the right end of the illustration in FIG. 1.

The production line has a first horizontal conveyor 1 and a second horizontal conveyor 2, which runs transversely thereto and which lead into a horizontally conveying turnout 4, to which a third horizontal conveyor 3 connects, which is arranged in alignment with the first horizontal conveyor 1. The first horizontal conveyor 1 consists of a plurality of sections, starting with a section 5, to which the individual glass plates 52, 53 are placed one after the other, of a section, which leads through a machine 6 for washing and drying the glass plates, and of two sections 7 and 8, which serve the intermediate transport and, if necessary, also for retaining the glass plates 52, 53. In section 7, it is furthermore also possible to check whether the washed glass plates are actually clean. In sections 5 to 8, the first horizontal conveyor 1 has a horizontal row of synchronously driven rollers 9, which are located in the sections 5, 7 and 8 at the lower edge of a support wall 10, which is inclined backwards against the vertical by few degrees, e.g. by 6°, and which is preferably embodied as an air cushion wall. The glass plates are conveyed while standing on the rollers 9 and leaning against the support wall 10. The glass plates are supported in the washing and drying machine 6 in an inherently known manner by means of an arrangement of washing brushes and rollers.

The second horizontal conveyor 2 also has a plurality of sections 11, 12, 13, 14 and 15, in which provision is made in each case for a continuous conveyor belt 16 comprising a horizontally running upper run at the lower edge of a support wall 17, which is inclined backwards out of the vertical position at the same angle as the support wall 10. Advantageously, the upper run is arranged at a right angle to the support wall 10 and is thus also inclined backwards by a few degrees. The second horizontal conveyor 2 serves to convey rectangular or square frames 51 (see FIG. 1), which are formed from plastic hollow profiles. They are placed onto the conveyor belt 16 with one of their legs and are leaned against the support wall 17, in which strips, which are preferably provided with bristles, in particular with soft bristles, for reducing the friction, are inserted or adhesively secured. A row of free-running guide rollers 18, which are partially located beneath the support wall 17, but which project beyond it and which in each case have an axis, which runs vertically to the upper run of the conveyor belt 16, is located closely above the conveyor belt 16. Provision is preferably made at a distance to the support wall 17 for a further row of support rollers 19, the height of which can be adjusted and which, if necessary, serve to prevent a tilting of the frame standing on the conveyor belt 16.

In section 11 of the second horizontal conveyor 2, the frames formed from the plastic hollow profiles 21 are placed onto the horizontal conveyor 2.

A system 20 is assigned to the section 12 of the second horizontal conveyor 2, which system 20 serves to inject an adhesive compound, in which a desiccant is embedded, into the space between two webs of the plastic hollow profile, from which the frame 51 for the window sash is formed. An example of such a plastic hollow profile is illustrated in cross section in FIGS. 16 to 19. The illustrated plastic hollow profile 21 has a plane outer face 22, a structured inner face 23, two flanks 24 and 25 and several hollow chambers. Two webs 26 and 27, which are parallel to the flanks 24 and 25 and parallel to each other and the space between which is open towards the inner face of the frame 51, are located on the inner face 23. The webs 26, 27 are angled at their free end and thus form a projection 28, against which the glass plates 52, 53 can hit, for which the webs 26 and 27 serve as spacers, see FIG. 18. An adhesive compound 29, in which a desiccant is embedded, is injected into the space between the webs 26 and 27 by means of the system 20. A polyisobutylene is particularly suitable as adhesive compound 29 and molecular sieves are particularly suitable as desiccant. Advantageously, the adhesive compound 29 is injected by means of a nozzle 30, which can be displaced up and down parallel to the support wall 17 and which can be rotated about an axis, which is perpendicular to the support wall 17. For injecting the adhesive compound 29 into the space between the vertical webs 28, the nozzle 30 is moved up or down, respectively, while the frame 51 formed from the hollow profile 21 rests. The adhesive compound 29 is injected into the space between the horizontal webs 26 and 27, while the frame 51 formed from the hollow profile 21 is conveyed back or forth horizontally, respectively, and the nozzle 30 rests.

Figure 16:
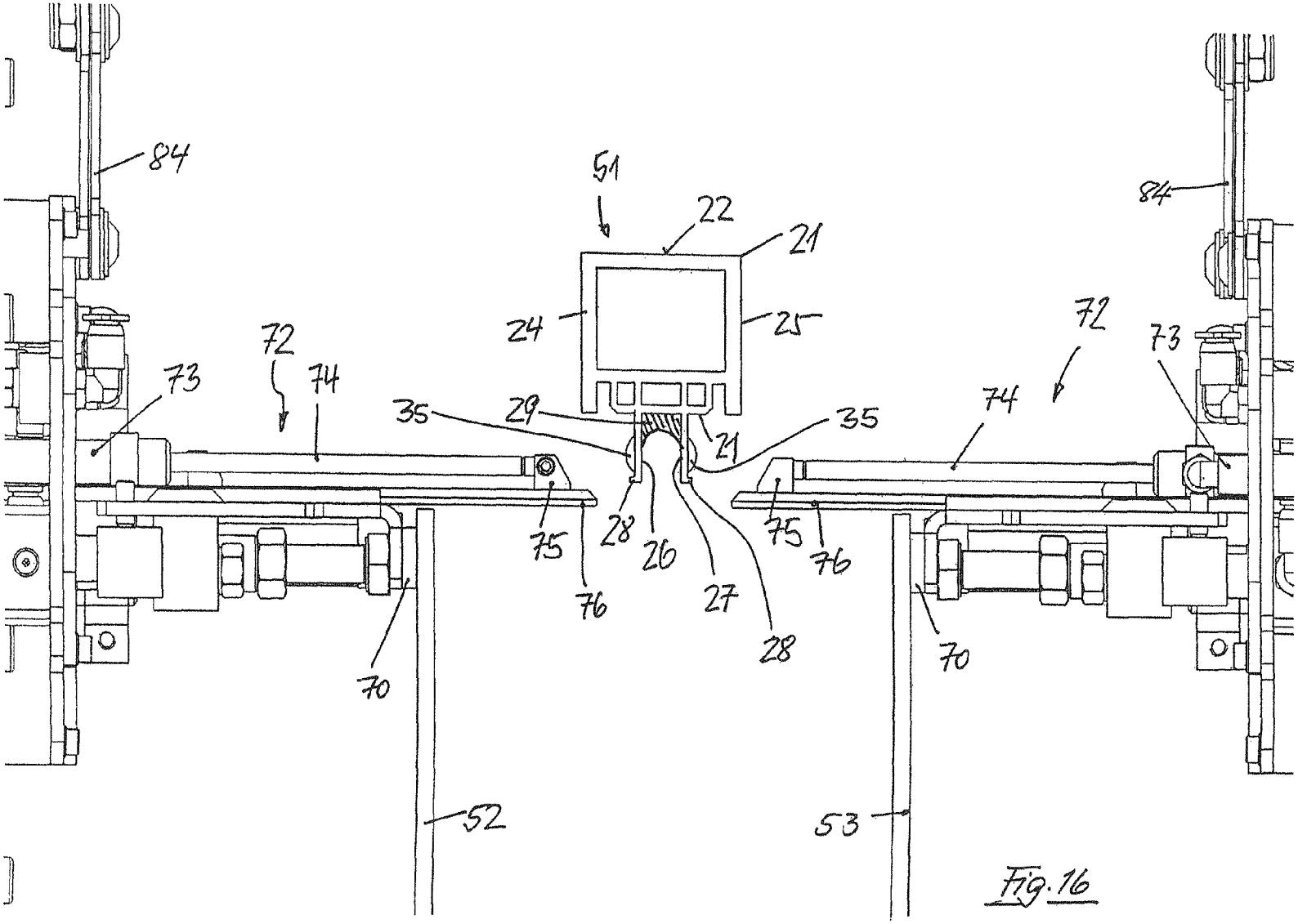
FIGS. 16-18 show three subsequent phases of the assembly of the window sash, illustrated in the area of the upper edge thereof.
Figure 17:
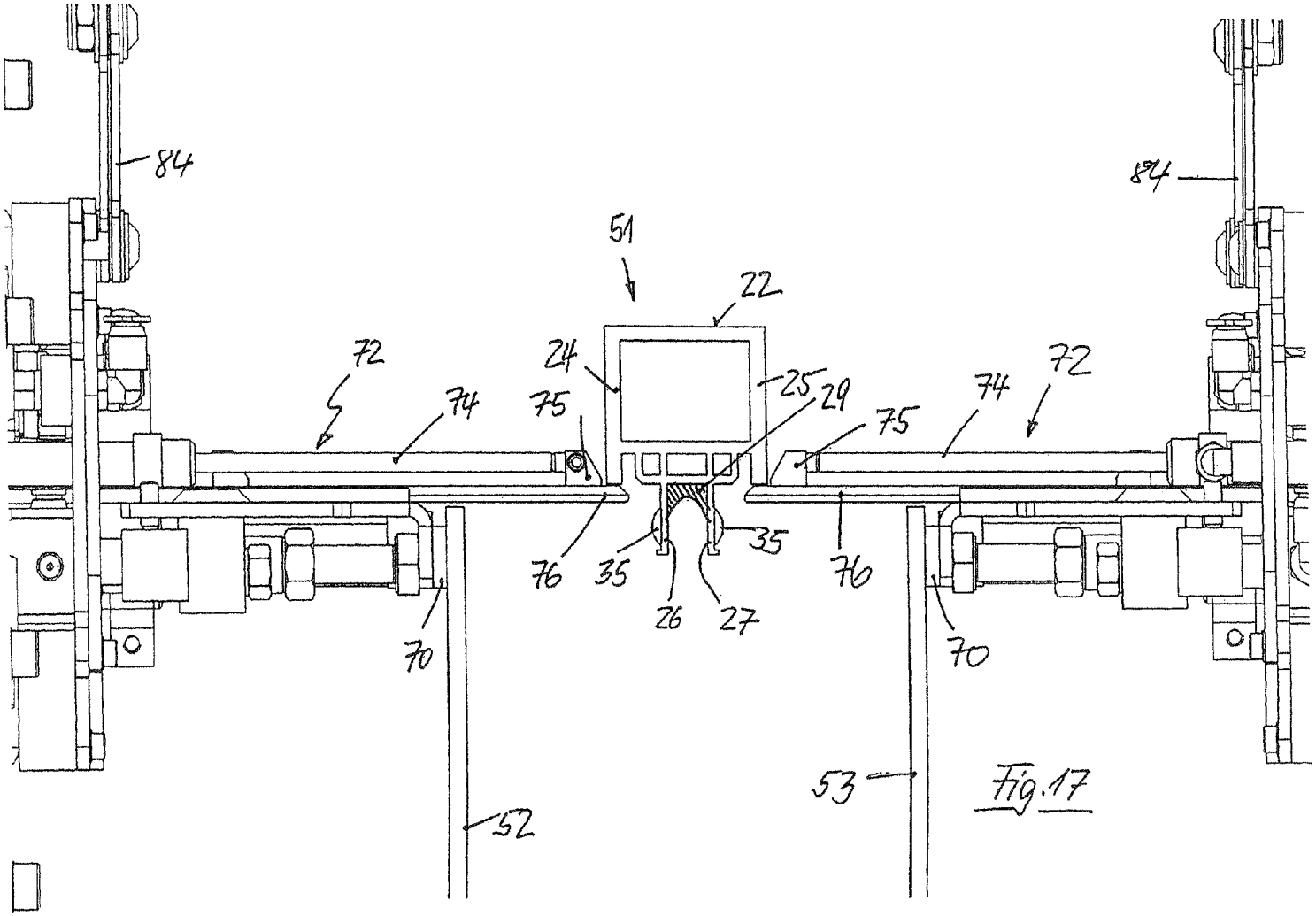
Figure 18:
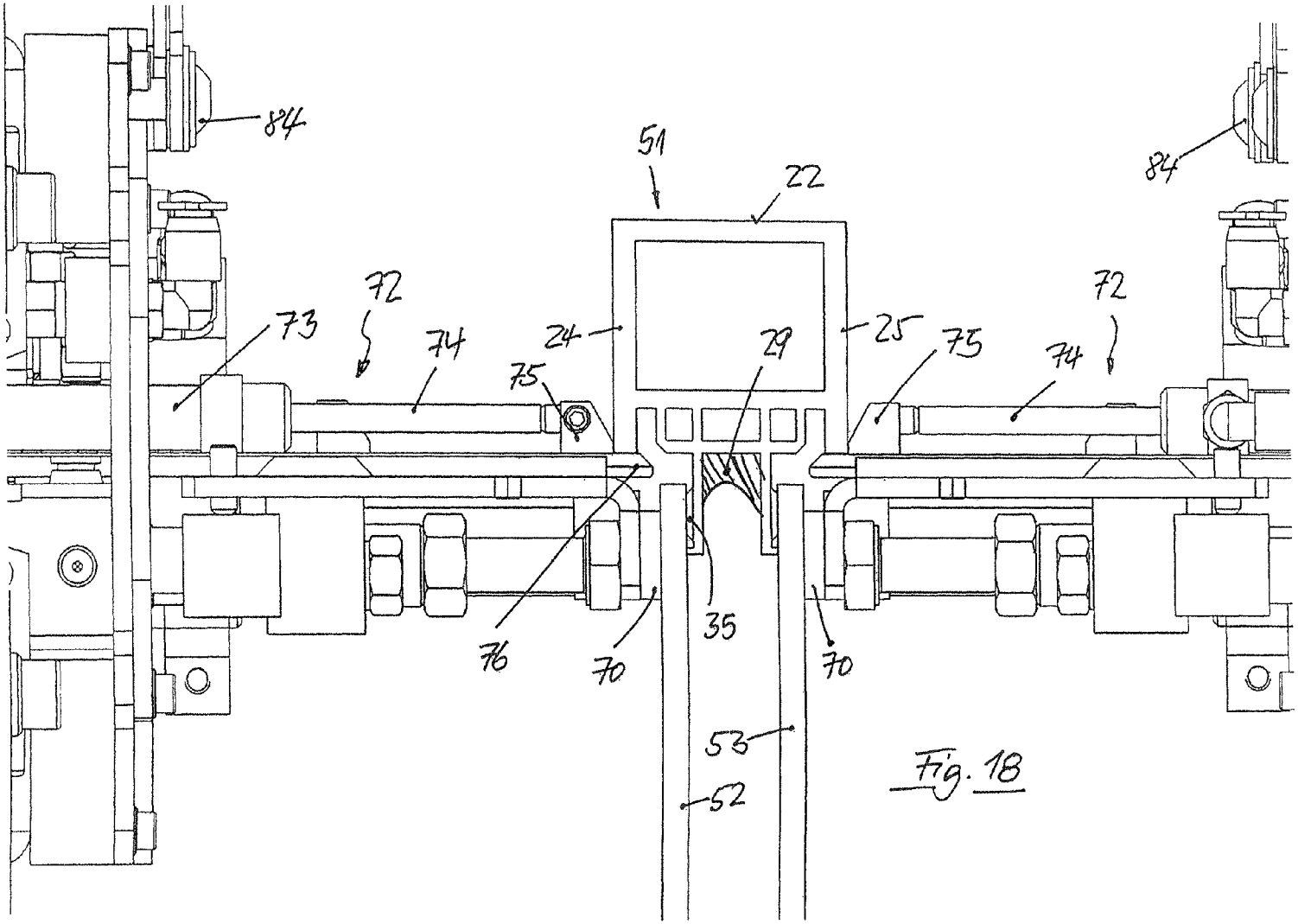

A system 31 for applying a line 35 of a sealing compound to the faces of the webs 26 and 27, which face away from each other, is assigned to the section 14 of the second horizontal conveyor 2. For this purpose, a first nozzle 32 is located in front of the support wall 17 and a second nozzle 33 is located behind the support wall 17, from where it can engage through the support wall 17 through a slot 34 therein, which runs from the bottom to the top. The nozzles 32 and 33 can be moved in the same manner as the nozzle 30 and they are moved and activated synchronously, so that they simultaneously apply the sealing compound to the outer face of the two webs 26 and 27. The line 35 of the sealing compound is illustrated in FIGS. 16 to 18.

The sections 13 and 15 of the second horizontal conveyor 2 serve for the intermediate transport of the frames. If necessary, lattice bars can be inserted into the frame 51 in section 13.

The section of the production line illustrated in FIG. 1 starts with the turnout 4, which can be pivoted back and forth between the two positions illustrated in FIG. 1. The turnout 4 has a horizontal conveyor with a design, which is the same as or which is similar to one of the sections of the second horizontal conveyor 2 and which can thus be considered to be a pivotable continuation of the second horizontal conveyor 2. In the position, in which the turnout 4 is aligned with the first horizontal conveyor 1, it can take over the glass plates 52, 53, which have been conveyed to that location, and can transfer them into a preparation station 36. In the position, in which the turnout 4 is aligned with the second horizontal conveyor 2, it can take over a frame 51 for the window sash from said second horizontal conveyor 2. To be able to transfer the frame 51 into the preparation station 36, the turnout 4, however, must initially be pivoted into that position, in which it is aligned with the preparation station 36 and the first horizontal conveyor 1.

The preparation station 36 is illustrated in FIGS. 3 to 6. It has a frame-shaped framework 39 on an underframe 37, which has two rails 38, which are inclined backwards. On its front face, the framework 39 has two posts 40, which are inclined backwards and which project upwards at a right angle to the rails 38. The rails 38 run at a right angle to the conveying direction of the first and third horizontal conveyor 1 or 3, respectively. The posts 40 are inclined backwards at the same angle as the support walls 10. An arrangement of three horizontal beams 41, 42 and 43 is supported at the posts 40 so as to be displaceable up and down, so that the height of the beams 41, 42 and 43 can be adjusted. The three beams 41, 42 and 43 in each case support a horizontal row of free-running support rollers 44, which can be rotated about axes, which run parallel to the posts 40. A three-track horizontal conveyor 45, which encompasses a horizontal support 46 for three continuous conveyor belts 47, 48 and 49, the upper runs of which are arranged parallel to each other at a distance and which are inclined backwards at the same angle as the posts 40, is attached to the framework 39 in the lower area thereof. The two outer conveyor belts 47, 49 serve to convey glass plates 52, 53, whereas the middle conveyor belt 48, which is wider than the outer conveyor belts 47 and 49, is intended to convey a frame 51 for a window sash. The conveyor belts 47 to 49 can be driven separately. On the support, free-running support rollers 50 are arranged on both sides of the conveyor belts 47 and 49. They serve the purpose of guiding the lower edge of the glass plates and of the frame for the window sash. The axes thereof run parallel to the axes of the rollers 44, which are attached to the beams 41, 42 and 43.

By transversely displacing the framework 39 on the rails 38 of the underframe 37, each of the three conveyor belts 47, 48 and 49 can be brought into alignment with the horizontal conveyor of the turnout 4. In the position illustrated in FIG. 1, the turnout 4 can transfer a frame 51 for a window sash to the middle conveyor belt 48; the support rollers 18 of the turnout 4 are aligned with the support rollers 50, which are arranged between the rear conveyor belt 49 and the middle conveyor belt 48, and which are inclined backwards at the same angle as the posts 40. To transfer a glass plate 53 to the rear conveyor belt 49, the latter is positioned by transversely displacing the support 46 such that the support rollers 50 arranged behind the conveyor belt 49 are aligned with the support rollers 18 in the turnout 4. To be able to transfer a glass plate 52 to the front conveyor belt 47, the latter is positioned by transversely displacing the support 46 such that the support rollers 50 arranged between the front conveyor belt 47 and the middle conveyor belt 48 are aligned with the support rollers 18 in the turnout 4.

In the preparation station 36, the frame 51 and the two glass plates 52 and 53 are preferably positioned such that the front vertical edges thereof are located approximately next to each other and are adjacent to the subsequent assembly station 54.

The assembly station 54 is illustrated in FIGS. 7 to 15. It has an underframe 55 comprising rails 56, the incline of which corresponds to the incline of the rails 38 in the preparation station 36. A framework 57 is attached to the underframe 55, which framework 57 is similar to the framework 39 of the preparation station 36 and, as does the latter, has an arrangement of three beams 58, 59, and 60, to which a horizontal row of support rollers 61 is attached in each case, the axes of which run approximately vertically, namely at a right angle to the rails 56. As in the case of the arrangement of the beams 41 to 43 in the preparation station 36, the arrangement of the beams 58 to 60 is attached at the posts of the framework 57 in a height-adjustable manner. In contrast to the displaceable framework 39 in the preparation station 36, the framework 57, however, is fixed on the underframe 55 so as not to be able to be displaced. A three-track horizontal conveyor 62, the design of which corresponds to the three-track horizontal conveyor 45 in the preparation station 36, is attached to the underframe 55 so as to be height-adjustable.

Figure 7:
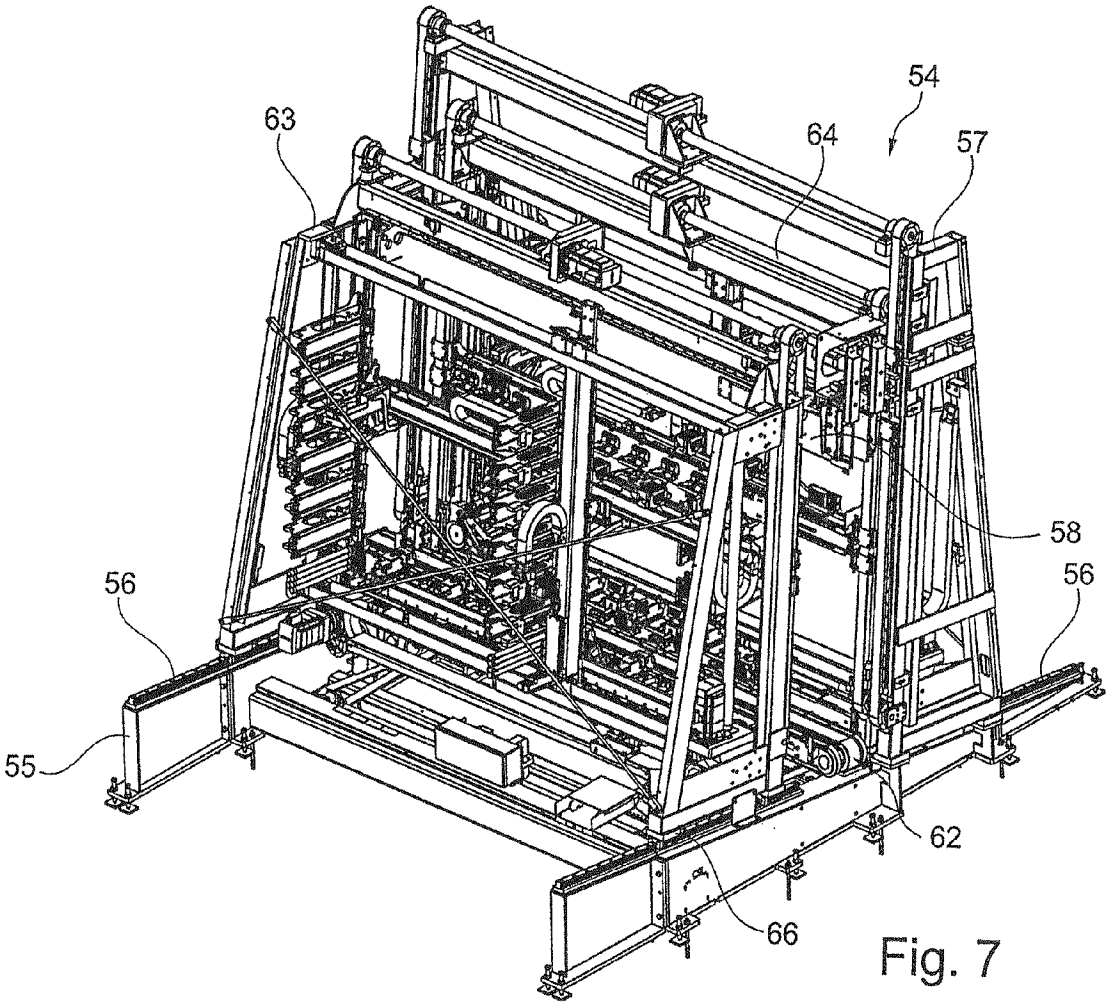
FIG. 7 shows the assembly station from FIG. 1 in a transversal view.
Figure 8:
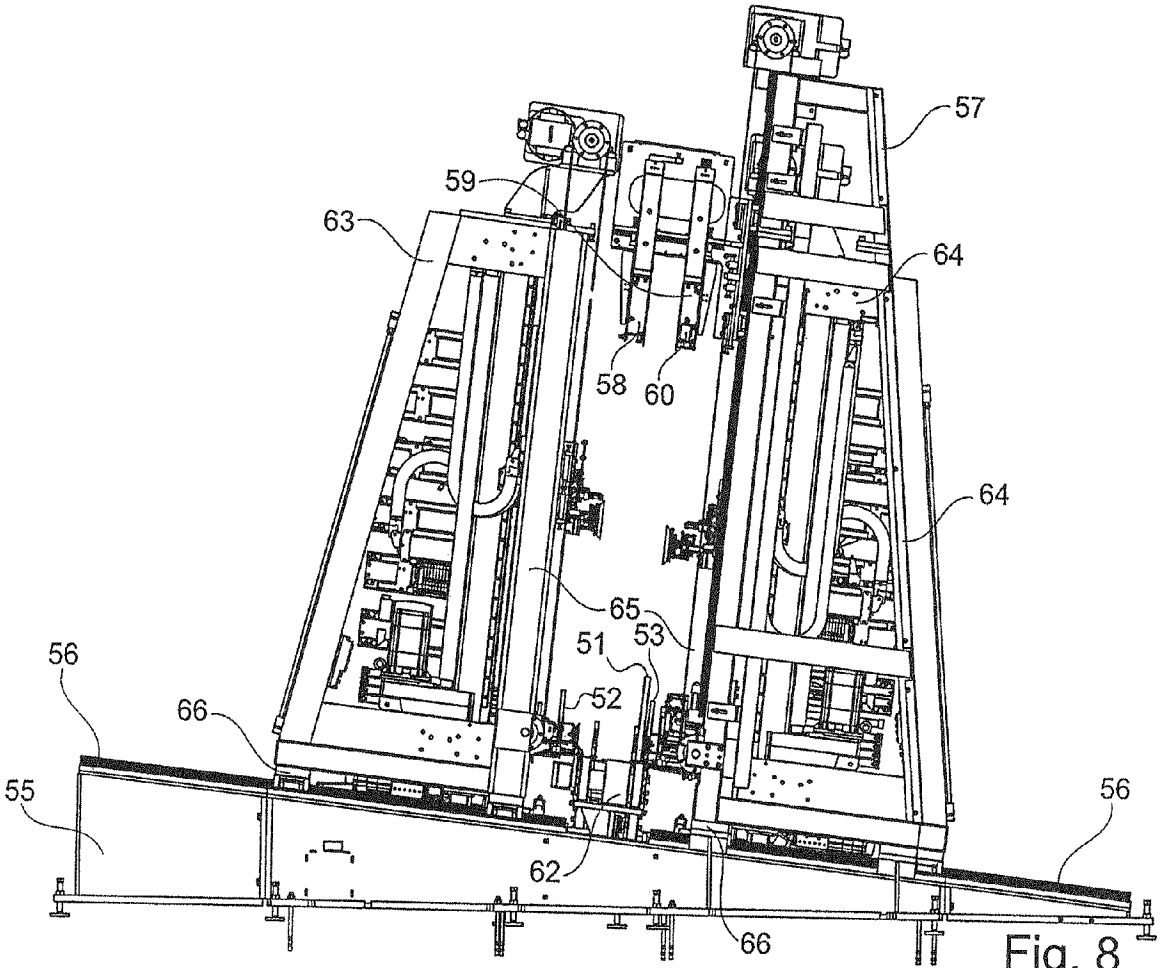
FIG. 8 shows the assembly station in a side view parallel to the conveying direction.

A front framework 63, which can be displaced on a pair of rails 56, is arranged in front of the stationary framework 57. A rear framework 64, which can also be displaced on a pair of rails 56, is arranged behind the stationary framework 57. FIG. 2 shows a view of the rear framework 64. At their lower ends, two lateral posts 65 of the rear framework 64 have undercut guide parts 66, which engage around the rails 56. At the posts 65, a horizontal traverse 67 is attached, which can be displaced up and down at the post 65 by means of gear belts 68, which are driven by a motor 69. Thrust plates 70 are attached to the traverse 67, which thrust plates 70 can be activated by means of pressure medium cylinders 71, in particular by means of pneumatic cylinders, which are illustrated in FIGS. 7 and 8, but which are not visible in FIG. 9, because they are located behind the traverse 67. Provision is made above each thrust plate 70 for an adjusting device 72, see FIG. 16, consisting of a pneumatic cylinder 73, the piston rod 74 of which has a head 75, to which a retractable bar 76, which is guided parallel to the piston rod 74, is attached. The adjusting device 72 serves the purpose of positioning the upper leg of the frame 51 and to remove a possible sagging of the upper leg of the frame 51, see FIGS. 16 to 18.

Thrust plates 70, which are also individually activated by means of pressure medium cylinders, and additionally a row of suction devices 78 are attached to a lower traverse 77 of the rear framework 64. A further suction device 78 is attached to the horizontal traverse 68. The suction devices 78 as well as the thrust plates 70 can be displaced individually by means of pressure medium cylinders 89, in particular by means of pneumatic cylinders. An upright traverse 80, which is parallel to the posts 65, is attached to the lower traverse 77 and to an upper traverse 79 of the rear framework 64, so as to be displaceable horizontally. The upright traverse 80 crosses the horizontal traverse 67 and is arranged behind the latter. The displacement of the upright traverse 80 takes place in the same manner as in the case of the horizontal traverse 67 by means of two gear belts 81, which are driven by a motor 82. Further thrust plates 70 and 70*a*, which can also be activated individually by means of pressure medium cylinders, are attached to the upright traverse 80 and to the post 65, which is parallel thereto. Most of the thrust plates 70 are attached to the traverses 67, 77 and 80 as well as to the post 65, in each case on a slide 83, which drags along smaller thrust plates 70*a*, which are attached to a slidable lattice grate 84, whereby the distance of the thrust plates 70, 70*a*, which are connected by the slidable lattice grate 84, from each other changes. The length adjustment effected by the slidable lattice grate 84 allows for the position of the thrust plates 70 and 70*a* to be optimally adapted to the height and width of the frames 51. The displaceability of the traverses 67 and 80 also serves for the adaptation to height and width of the frames 51 for the window sashes.

Figure 9:
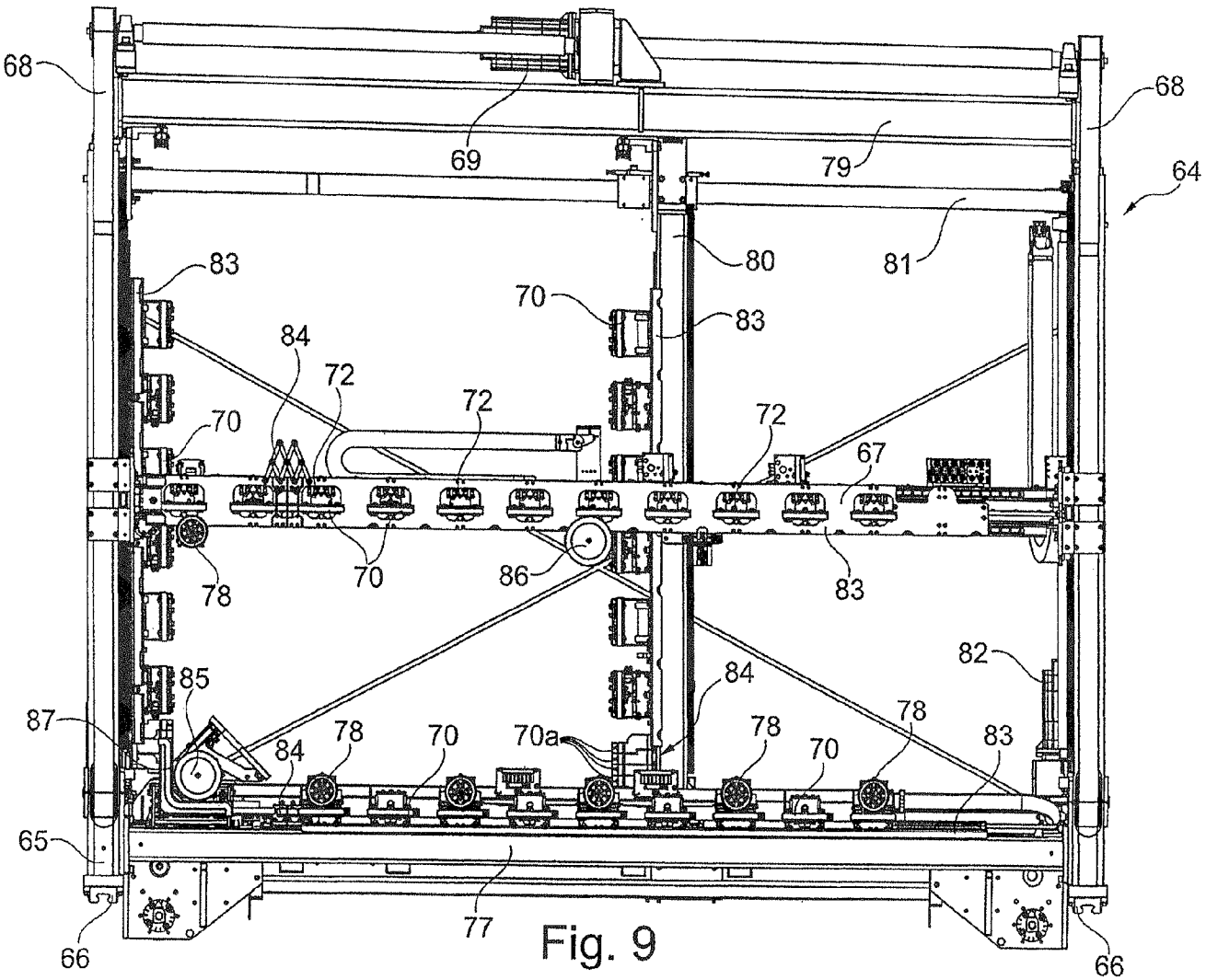
FIG. 9 shows the rear part of the assembly station from FIG. 8 in a front view.

FIG. 9 furthermore shows two suction devices 85 and 86, which are larger than the suction device 78. In the view of FIG. 9, the lower suction device 85 is located in the left lower corner of the field defined by the traverses 67, 77, 68 and by the post 65 and is attached to the lower traverse 77. The upper suction device 86 is located in the diagonally opposite corner of this field. While the lower suction device 85 can only be moved back and forth and otherwise maintains its position at the lower traverse 77, the upper suction device 86 can additionally follow the movements of the traverses 67 and 80, so that it maintains its position in the corner of the field, which is determined by the position of the traverses 67 and 80. A glass plate 53, which is held by the suction devices 78 in the field, which the traverses 76, 70, 68 and the post 65 span, can be bent backwards at two diagonally opposite corners by means of these suction devices 85 and 86. In addition, the larger suction devices 85, 86 contribute to the fixing of the glass plates 52, 53, which must take place before the three-track horizontal conveyor 62 can be lowered. The larger suction devices 85 and 86 can be displaced by means of pressure medium cylinders, in particular by means of pneumatic cylinders 89 in the same manner as the smaller suction devices 78.

With the help of the larger suction devices 85 and 86, an access to the space between the two glass plates 52, 53 of the window sash can be held open temporarily during the assembly of a window sash for the purposes of a gas exchange. Air in the space between the glass plates 52 and 53 is replaced with heavy gas during the gas exchange. Advantageously, the heavy gas is supplied in the area of the lower corner in the vicinity of the lower suction device 85 and displaces the air through the opening in the area of the upper suction device 86 located diagonally opposite thereto. So that the heavy gas does not discharge again through the access, which is held open by the lower suction device 85, provision is made at that location for a two-legged seal 87, which covers the gap between the frame 51 and the rear glass plate 53 in the lower corner of the frame 51 and thus seals the access to the space between the glass plates 52, 53. The seal 87 can be a molded part, e.g. consisting of a foam rubber or the like. A feed line 88 for the heavy gas, which is to be supplied, extends through the seal 87. The end section of the feed line 88, which is guided through the seal 87, is preferably a porous pipe piece, the end of which is closed, which can consist, e.g., of a sintered plastic, from which the heavy gas escapes in a diffuse manner, flows into the space between the glass plates 52, 53 and displaces the air at that location upwards such that the air leaves the space via the opening provided by the upper suction device 86.

Figure 10:
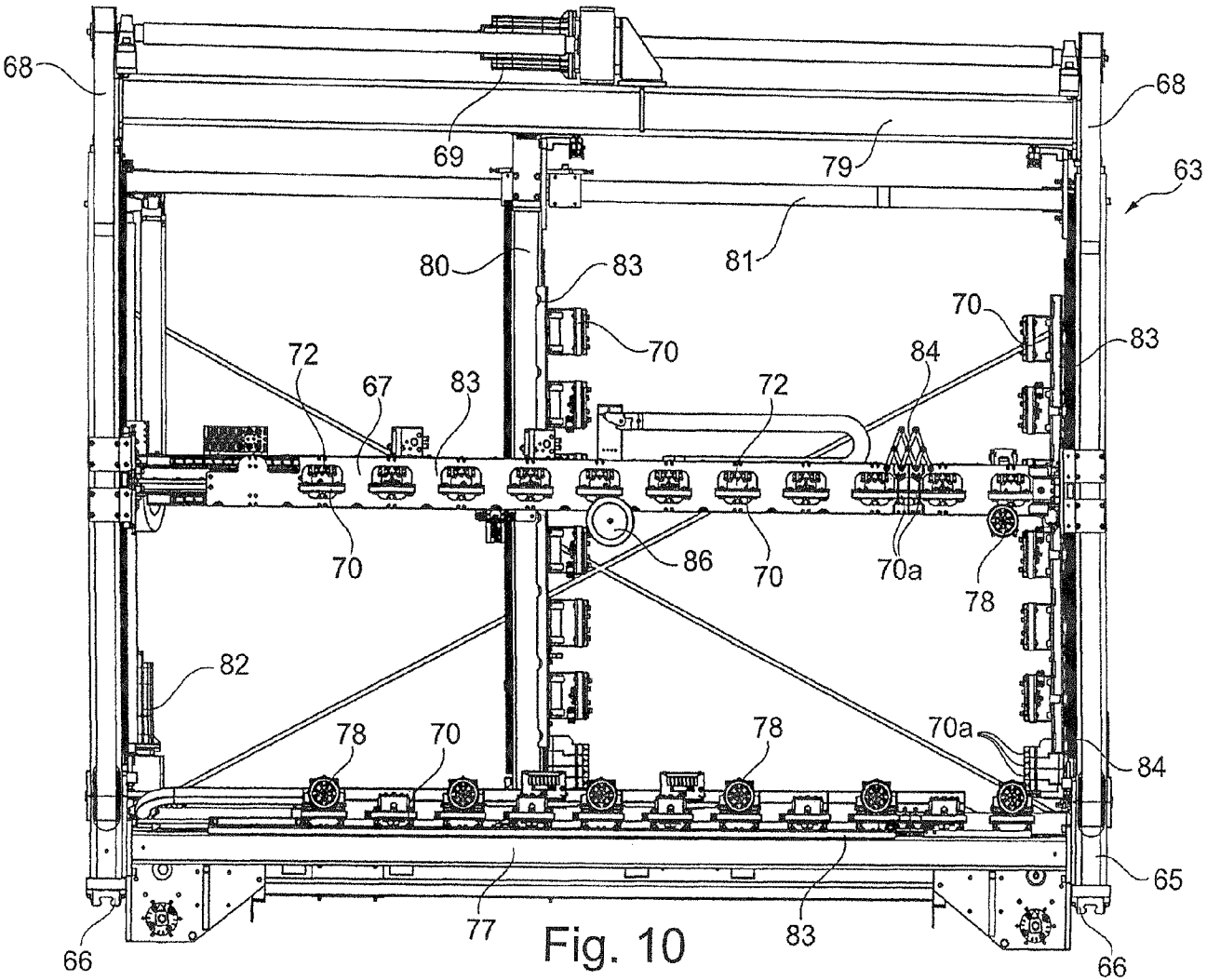
FIG. 10 shows the front part of the assembly station from FIG. 8 in a view seen from the rear part of the device.
Figure 11:
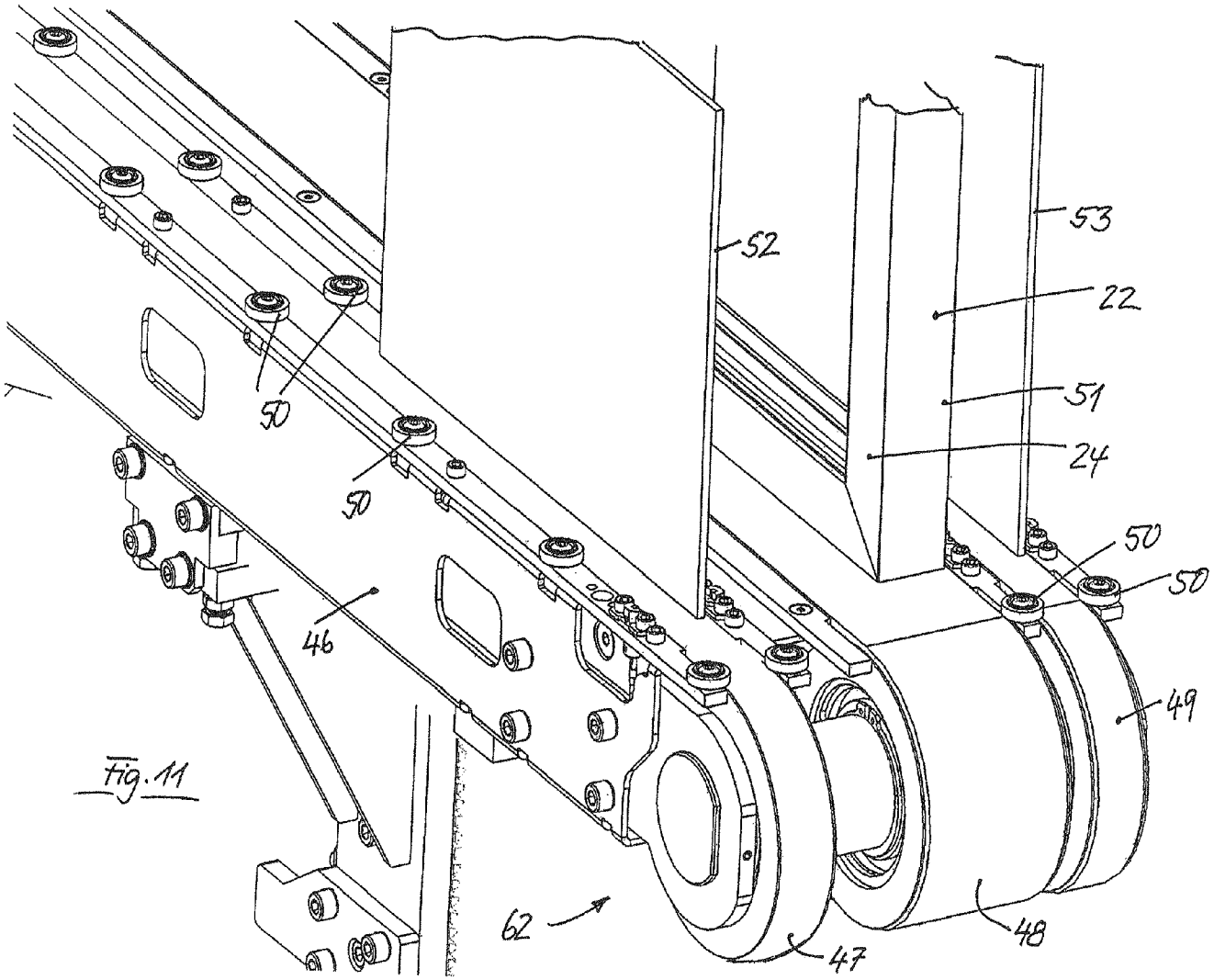
FIG. 11 shows, as a detail, a transversal view onto the outlet end of the assembly station having a window frame and two glass plates, which are located parallel next to each other.
Figure 12:
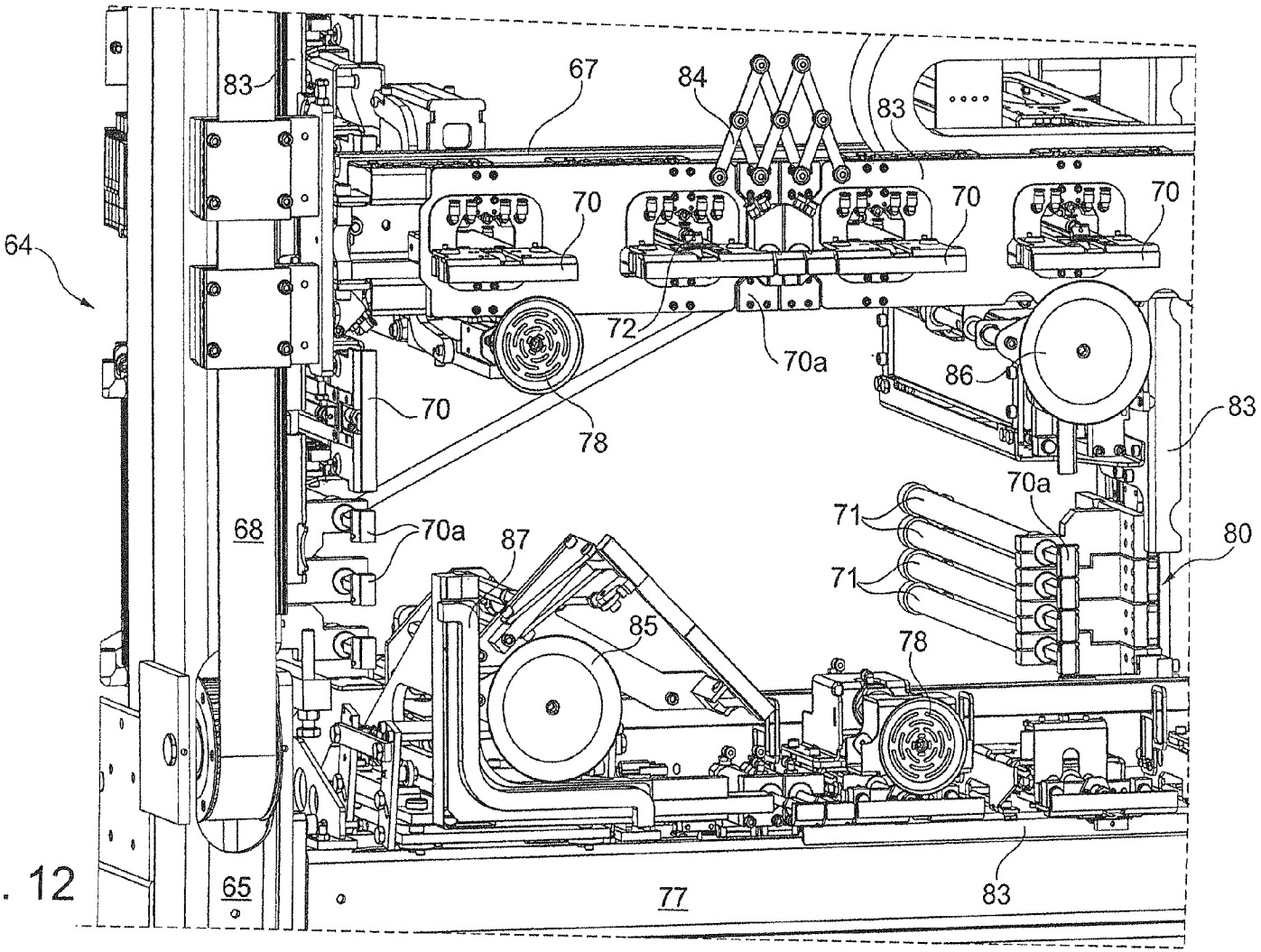
FIG. 12 shows, as detail C, a section of the rear part of the assembly station.
Figure 13:
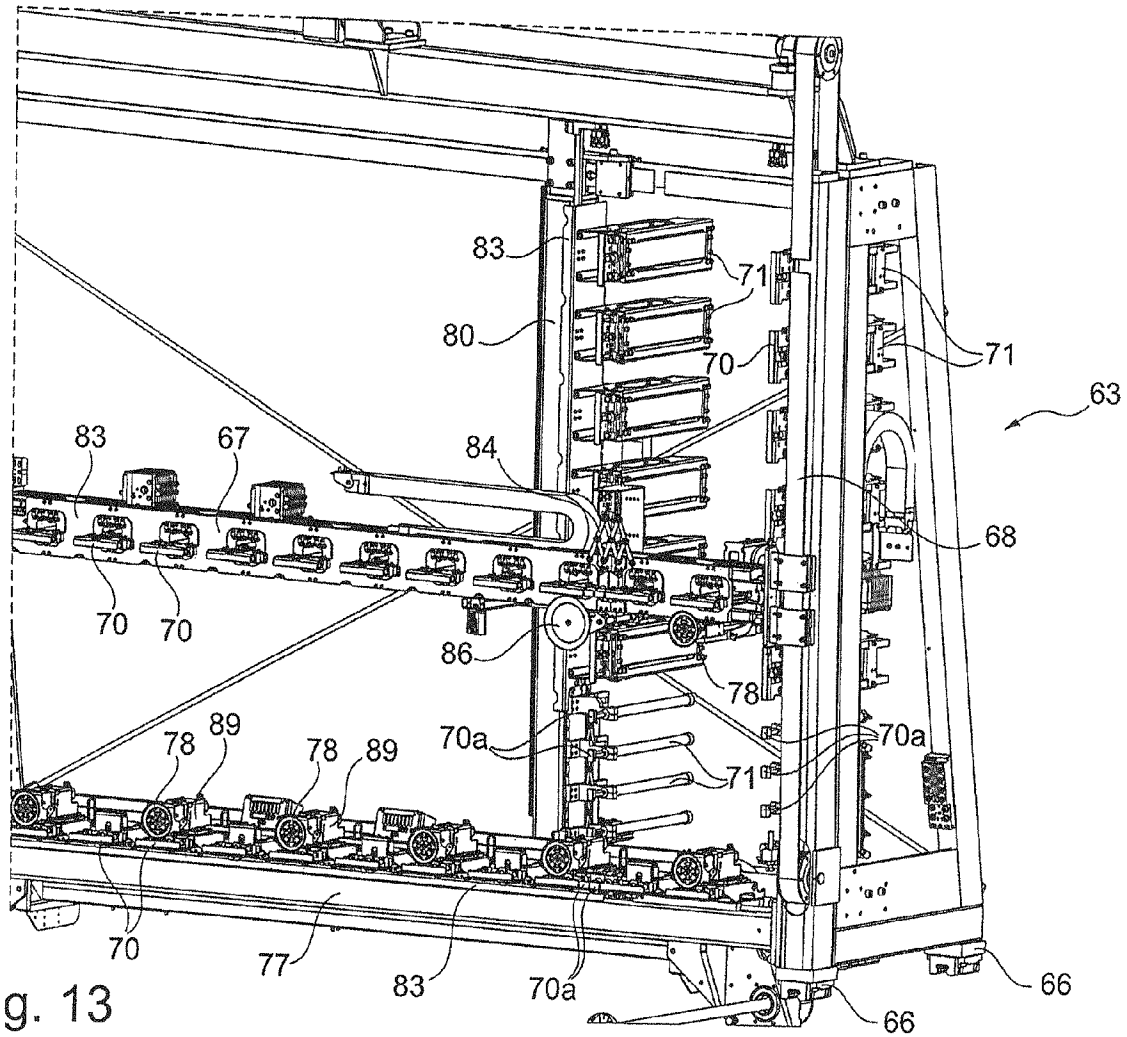
FIG. 13 shows, as detail D, a section of the front part of the assembly station.
Figure 14:
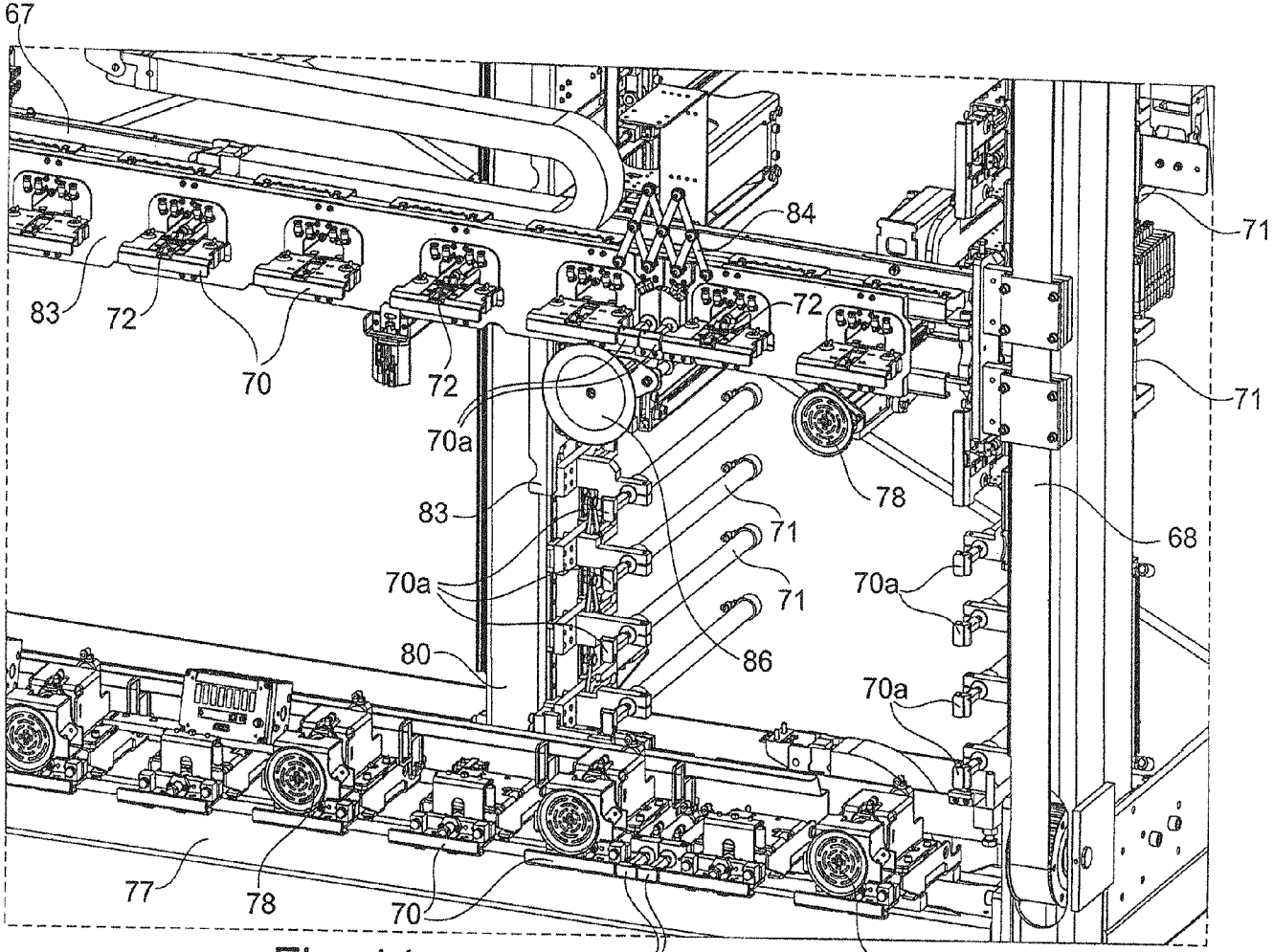
FIG. 14 shows a first section from FIG. 13.
Figure 15:
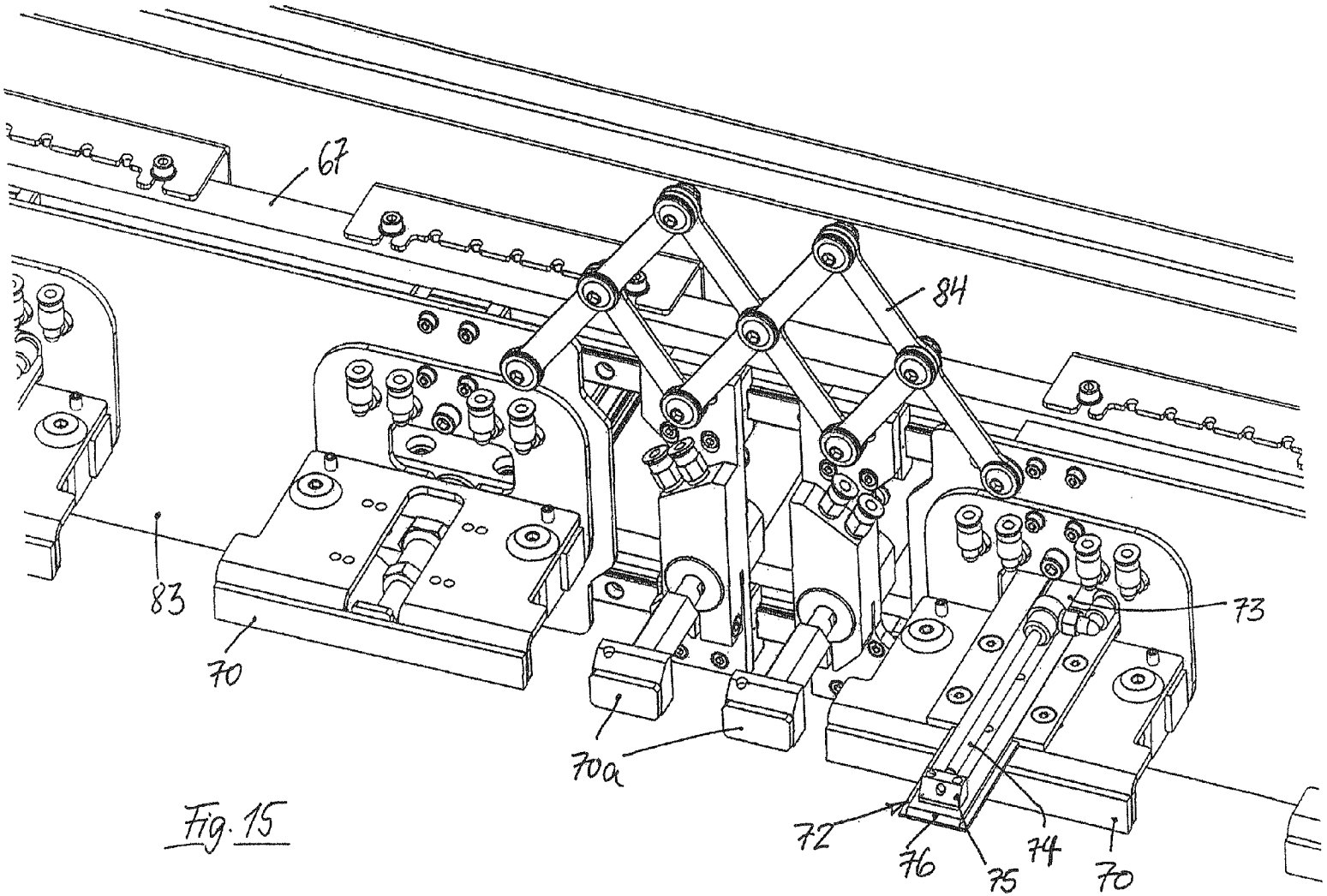
FIG. 15 shows a second section from FIG. 13 with changed adjustment.

FIG. 10 shows a view of the front framework 63, which corresponds to the view of FIG. 9, which is arranged in front of the three-track horizontal conveyor 62 in the assembly station. This front framework 63 is substantially a mirror image of the rear framework 64, so that reference can be made to the description of the rear framework 64 with reference to the details. The front framework 63, however, does not have the larger suction device 85, the seal 87 and also not a feed line 88 for a heavy gas.

The window sashes are assembled in the described production line according to the following method:

The two glass plates 52 and 53 required for a window sash are placed onto section 5 of the first horizontal conveyor 1. The frame 51 required for the window sash, which is premanufactured from plastic hollow profiles, is placed onto section 11 of the second horizontal conveyor 2. The glass plates 52 and 53 are conveyed consecutively through the washing and drying machine 6, can be checked for cleanliness in section 7 of the first horizontal conveyor 1, reach section 8 of the first horizontal conveyor 1, on which they can be stored, if necessary, when the turnout 4 or the preparation station 36 following it should not yet be ready. The turnout 4 is ready for the glass plates 52 and 53 when it is aligned with the first horizontal conveyor 1 and when it is empty. In this case, the two glass plates 52 and 53 are conveyed consecutively onto the turnout 4. When the preparation station 36 is ready, it is positioned by means of lateral displacement such that either the support rollers 50 arranged behind the rear conveyor belt 49 or the support rollers 50 arranged between the front conveyor belt 47 and the middle conveyor belt 48, are aligned with the support rollers 18 of the turnout 4. In the last-mentioned case, the first glass plate 52 is then conveyed on the front conveyor belt 47, is conveyed by it just in front of the outlet end of the preparation station 36 and is stopped there. By transversely displacing the framework 39, the conveyor track intended for the second glass plate 53 with the rear conveyor belt 49 is then displaced to be aligned with the turnout 4 and the turnout 4 conveys the second glass plate 53 to the rear conveyor belt 49, which conveys it up to the outlet end of the preparation station 36 and stops it there. The three-track horizontal conveyor 62 is subsequently positioned such that its middle conveyor track comprising the wider conveyor belt 48 is aligned with the first horizontal conveyor 1.

Overlapping in time with the passage of the two glass plates 52 and 53 through the first horizontal conveyor 1, the adhesive compound, in which a desiccant is embedded, is injected into the space between the two webs 26 and 27 of the frame 51 on the second horizontal conveyor 2 in section 12 thereof. If desired, it is possible to insert lattice bars into the frame 51 in section 13 of the second horizontal conveyor 2. In the subsequent section 14 of the second horizontal conveyor 2, a continuous line 35 of a sealing compound is applied to the outer face of the two webs 26 and 27 without interruption. In the subsequent section 15 of the second horizontal conveyor 2, the frame 51, which is prepared and coated in this manner, can be stored until the turnout 4 is free and is pivoted into its position, which is aligned with the second horizontal conveyor 2. The frame 51 is subsequently conveyed onto the turnout 4. As soon as this has taken place, the turnout 4 pivots back into alignment with the first horizontal conveyor 1. If this has not taken place until then, by transversely displacing on the underframe 37, the framework 39 of the preparation station 36 with the line of support rollers 50 arranged between the middle conveyor belt 48 and the rear conveyor belt 49 is next brought into alignment with the support rollers 18 in the turnout 4. As soon as this has taken place, the frame 51 is conveyed onto the middle conveyor belt 48 and is further conveyed by it to the outlet end of the preparation station 36. If the subsequent assembly station 54 is ready for take-up, the frame 51 can run into the assembly station 54 without stopping and the two glass plates 52 and 53 are simultaneously conveyed out of the preparation station 36 into the assembly station 54. In the event, however, that the assembly station 54 is not yet ready, the frame 51 is stopped in the preparation station 36. The frame 51 and the glass plates 52 and 53 have then assumed the position illustrated in FIG. 1. As soon as the assembly station 54 is ready, the frame 51 and the two glass plates 52 and 53 are simultaneously conveyed into the assembly station 54 and are moved into the proximity of the outlet end thereof, where they are stopped—e.g. controlled by means of position sensors—such that the upright edges of the two glass plates 52, 53 in conveying direction are centered towards the upright edges of the two webs 26 and 27 of the frame 51. Due to the fact that the upper runs of the conveyor belts 47, 48 and 49 are located in a common plane, the height of the glass plates 52 and 53 is not yet correctly oriented towards the height, which they must assume in the frame 51, see FIG. 11.

To attain this, the suction devices 78 provided in the two frameworks 63 and 64 of the assembly station 54 are pushed ahead up to the adjacent glass plate 52 or 53, respectively, by activating pneumatic cylinders 89, at the piston rod of which in each case a suction device 78 is attached and activated, so that the two glass plates are aspirated and are fixed in their position. Only those suction devices 78, which are required for the length and height of the respective glass plates 52 and 53, are pushed forward and activated. The dimensions of the glass plates 52, 53 can be known from the production planning and can be provided by the control of the assembly station 54, or they can be determined by position sensors, which are provided in the assembly device 54. In this manner, the traverses 67 and 80 can be automatically adjusted to the current dimensions of the glass plates 52, 53 or to the corresponding frame 51, respectively. The adjustment of the traverses 67 and 80 to the dimensions of the current frame 51 includes the orientation of the thrust plates 70, 70*a*, for the purpose of which the slides 83 are displaced into such a position, in which the thrust plates 70, 70*a* are located opposite to the edge of the glass plates 52 and 53 at distances, which are as even as possible. Only suction devices 78 are activated, which are located in the field, which, in terms of FIG. 9, is located on the bottom left and is defined by the traverses 66, 67 and 80 as well as by the post 65. In addition, the larger suction devices 85 and 86 are pushed forward against the glass plates 52 and 53 and are activated.

Simultaneously with the suction devices 78, the thrust plates 70, 70*a* are also extended by their pneumatic cylinders 71 and come in contact to the glass plates 52, 53, see FIG. 16. In addition, the adjusting device 72 is now activated. For this purpose, the bars 76 are extended by activating the pneumatic cylinders 73, so that they reach underneath the flanks 24 and 25 of the upper leg of the frame 51, see FIG. 16.

The three-track horizontal conveyor 62 can now be lowered in the assembly station 54. Through this, the upper leg of the frame 51 is placed onto the bars 76, see FIG. 17, and a possible sagging of the upper leg of the frame 51 is overcome. The three-track horizontal conveyor 62 is lowered until the horizontal edges of the glass plates 52 and 53 are centered on the horizontal edges of the webs 26 and 27. The lines 35 of the sealing compound are now located opposite to the glass plates 52, 53 close to the edge thereof.

Next, the beams 58, 59 and 60 are lifted, so that the support rollers 61 disengage from the glass plates 52, 53. The front framework 63 and the rear framework 64 are then both moved towards each other, whereby the glass plates 52 and 53 press against the line 35 of the sealing compound, which is located on the webs 26 and 27. The movement of the frameworks 63 and 64 is thereby cushioned by the pneumatic cylinders 71 of the thrust plates 70, 70*a*, which ensure a pressing of the glass plates 52, 53 against the webs 26 and 27 of the frame 51 at a predetermined pressure, see FIG. 18.

The window sash is thus assembled. The pneumatic cylinders of the thrust plates 70, 70*a* and of the adjusting device 72 retract their piston rods again, the suction devices 78, 85 and 86 are deactivated and pulled back, the three-track horizontal conveyor 62 is lifted back to the original height, which corresponds to the height of the horizontal conveyor in the preparation station 36, and the window sash is conveyed out of the assembly station 54 onto an outlet conveyor 90. If necessary, cover strips, which cover the edge of the glass plates 52 and 53, can be inserted here into the frame 51 in a manner, which is known per se.

Figure 19:
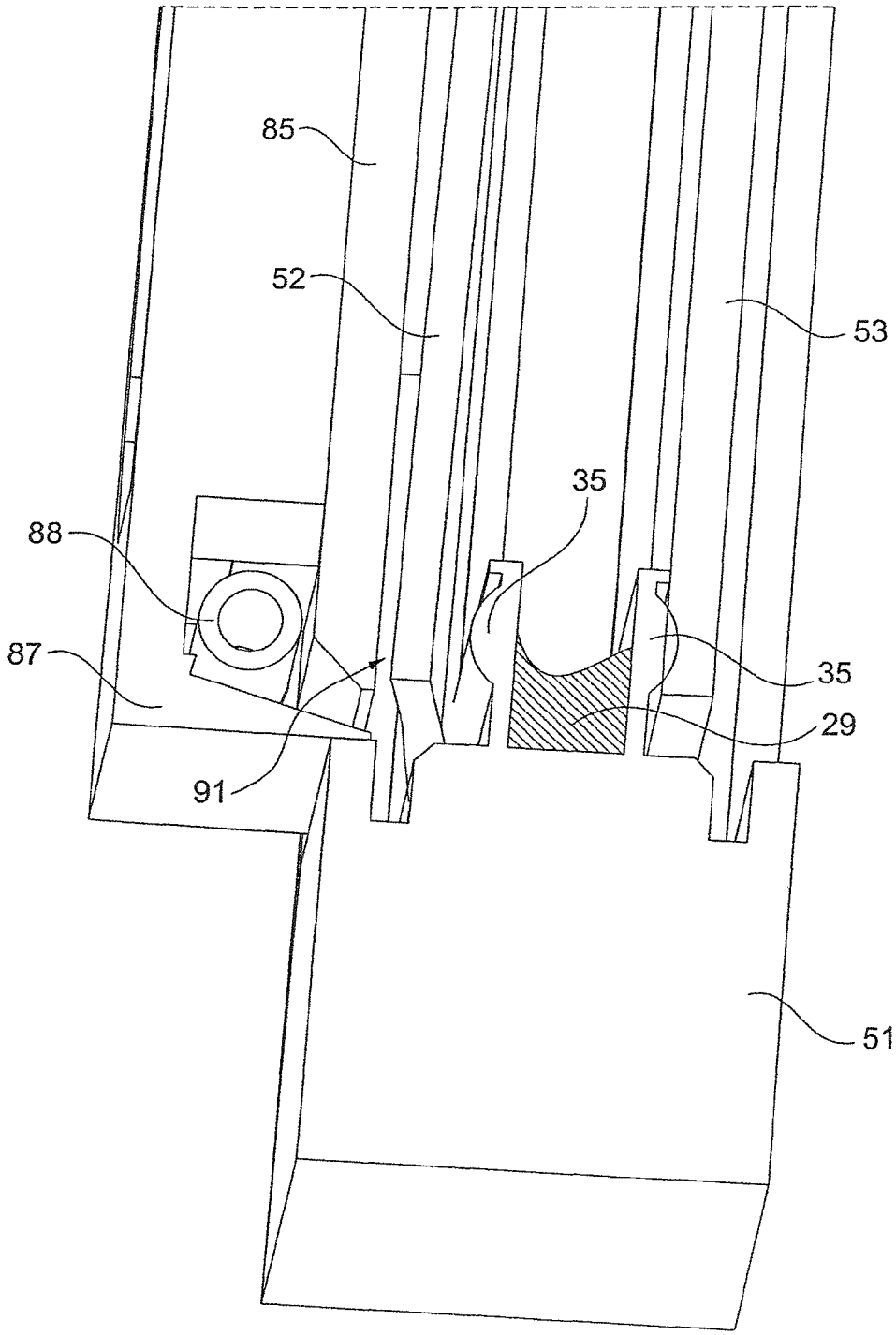
FIG. 19 shows a section of a partially assembled window sash having a glass plate, which is bent away, during the gas exchange.

In the event that the insulating glass pane, which is integrated into the window sash, is to be filled with a heavy gas, this takes place in that, prior to the pressing of the one glass plate 53 against the frame 51, the rear glass plate 53 is bent outwards at diagonally opposite corners by means of the suction devices 85 and 86—see FIG. 19—wherein the heavy gas is introduced through the access, which has been established by means of the suction device 85 and air is displaced from the space between the two glass plates 52 and 53 through the opening, which has been established by means of the suction device 86. Once a sufficiently high filling degree of the heavy gas has been reached, the suction devices 85 and 86 are deactivated, whereby the openings close easily due to the elastic resilience of the glass plates 52 and 53 and are closed by the impact of the pneumatically activated thrust plates 70, 70*a*. FIG. 19 shows in detail the access 91 at a lower corner of the window sash with the attached seal 87 and a section of the porous feed line 88, through which the heavy gas is supplied, and a part of the elastomeric suction plate of the suction device 85 between the seal 87 and the glass plate 53.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

The invention claimed is:

1. A device for assembling window sashes comprising an integrated insulating glass pane, wherein said window sashes comprise a frame formed from plastic hollow profiles comprising an inner face, an outer face facing away from the inner face, and two flanks which connect the inner face and the outer face to each other, wherein the frame, on the inner face of said frame, comprises two webs parallel to each other, said webs constituting an all-around delimitation of the window opening of the window sash adhesively secured to two glass plates, said two glass plates being held spaced apart by the two webs, said device further comprising, an underframe having a horizontal conveyor provided on said underframe and being height-adjustable;

a framework attached to the underframe, said framework projecting upwardly from the underframe and having at least three rows of support elements, said support elements being located next to one another, each of said rows being attached to a horizontal beam above the horizontal conveyor and parallel to said horizontal conveyor, said beam with said support elements being height-adjustable and arranged for supporting and guiding glass plates and frames conveyed together in parallel on the horizontal conveyor in a vertical position or in a position which is inclined backwards by a few degrees;

a front framework supported in front of the horizontal conveyor on the underframe, said underframe being embodied in a frame-shaped manner and being displaceable transversely to the horizontal conveyor on the underframe;

a rear framework arranged behind the horizontal conveyor on the underframe and being embodied in a frame-shaped manner and being displaceable transversely to the horizontal conveyor on the underframe;

wherein each of the front framework and the rear framework support a horizontal traverse being displaceable up and down, and support a vertical traverse being displaceable horizontally;

wherein thrust plates are each attached to a stationary lower horizontal traverse of the front framework and of the rear framework, to the displaceable horizontal traverse, to the displaceable vertical traverse and each to a post of the front framework and of the rear framework, wherein said posts project upwardly parallel to the vertical traverse and wherein said thrust plates are displaceable transversely horizontally or inclined by a few degrees against the horizontal, respectively, wherein the thrust plates attached to the front framework can be pushed ahead in the direction to the rear framework and the thrust plates provided at the rear framework can be pushed ahead in the direction to the front framework; and suction devices provided at the front framework and at the rear framework, and wherein the suction devices attached to the front framework face the rear frame work, while the suction devices provided at the rear framework face the front framework.

2. The device according to claim 1, wherein the horizontal conveyor is a three-track horizontal conveyor.

3. The device according to claim 2, wherein the three-track horizontal conveyor has three conveyor belts, said three conveyor belts being located next to one another, the upper runs of said three conveyor belts being located in a common plane.

4. The device according to claim 1, wherein the support elements are free-running rollers, the axes of said support elements being arranged vertically or inclined backwards by a few degrees against the vertical, respectively.

5. The device according to claim 1, wherein, in the case of the front framework as well as in the case of the rear framework, a part of the thrust plates is mounted on slides, one of said slides in each case being displaceable longitudinally on the fixed lower traverse, one on the movable horizontal traverse, one on the movable vertical traverse and one on the vertical post of the framework, said vertical post being located opposite to the vertical traverse, and wherein each one of the said slides tows a slidable lattice grate, said lattice grate changing its expansion due to the displacement movement and thrust plates being attached to said lattice grates, the distance of said lattice grates relative to one another and the distance of said lattice grates from the thrust plates mounted on the respective slide changing due to the movement of the slide.

6. The device according to claim 1, further comprising adjusting devices at the movable horizontal traverse of the front framework as well as of the rear framework, wherein said adjusting devices comprise arms, said arms being pushed forward from the displaceable horizontal traverse of the front framework transversely to the conveying direction of the horizontal conveyor in the direction of the opposite rear framework, whereas the adjusting devices provided at the displaceable horizontal traverse of the rear framework, can push arms of said adjusting devices forwardly transversely to the conveying direction of the horizontal conveyor in the direction of the opposite front framework.

7. The device according to claim 6, wherein the adjusting devices are activated individually.

8. The device according to claim 1, wherein the thrust plates are activated individually.

9. The device according to claim 1, wherein the suction devices are activated individually.

10. The device according to claim 1, further comprising suction devices either at the front framework or at the rear framework, wherein said suction devices are oriented against the opposite framework, and wherein an adjacent glass plate standing on the horizontal conveyor is aspirated and bent backwards by said suction devices away from the opposite glass plate at two corners, said corners being located diagonally opposite to one another.

11. The device according to claim 10, further comprising a feed line for introducing a heavy gas into the space between the two glass plates, is assigned to the lower suction device through the access to the interior, said access being formed by bending away the glass plate in the area of the lower suction device.

12. The device according to claim 7, wherein the adjusting devices are activated by pneumatic cylinders.

13. The device according to claim 8, wherein the thrust plates are activated by pneumatic cylinders.

14. The device according to claim 9, wherein the suction devices are activated by pneumatic cylinders.

15. The device according to claim 1, wherein said thrust plates are displaced at right angles to the conveying direction of the horizontal conveyor.

16. The device according to claim 6, wherein said arms of said adjusting devices are in the shape of bars.

* * * * *